US006810704B2

(12) United States Patent
Futamura et al.

(10) Patent No.: US 6,810,704 B2
(45) Date of Patent: Nov. 2, 2004

(54) PRESS FORMING MACHINE

(75) Inventors: Shoji Futamura, Kawasaki (JP); Keizo Unno, Tokyo (JP)

(73) Assignee: Institute of Technology Precision Electrical Discharge Work's, Atsugi (JP)

( * ) Notice: Subject to any disclaimer, the term of this patent is extended or adjusted under 35 U.S.C. 154(b) by 0 days.

(21) Appl. No.: 10/093,314

(22) Filed: Mar. 7, 2002

(65) Prior Publication Data

US 2002/0170337 A1 Nov. 21, 2002

(30) Foreign Application Priority Data

Mar. 15, 2001 (JP) ..... 2001-073419
Oct. 24, 2001 (JP) ..... 2001-326190

(51) Int. Cl.[7] ..... B21J 9/20
(52) U.S. Cl. ..... 72/17.2; 72/454; 100/46
(58) Field of Search ..... 72/454, 453.08, 72/390.06, 17.2, 443, 453.02; 100/258 R, 258 A, 46

(56) References Cited

U.S. PATENT DOCUMENTS 4,076,780 A * 2/1978 Ditto ..... 264/40.5
4,269,580 A * 5/1981 Wright ..... 425/150
4,480,538 A * 11/1984 Yoshida ..... 100/48
4,784,058 A * 11/1988 Nakagawa et al. ..... 100/35
5,156,782 A * 10/1992 Ballantyne ..... 264/40.5
5,243,902 A 9/1993 Plazenet
6,154,942 A * 12/2000 Toeniskoetter ..... 29/243.58
6,595,122 B1 * 7/2003 Mukai et al. ..... 100/46

FOREIGN PATENT DOCUMENTS

JP 2000-79500 3/2000
WO WO 93/05954 4/1993

* cited by examiner

*Primary Examiner*—Lowell A. Larson
(74) *Attorney, Agent, or Firm*—McGlew and Tuttle, P.C.

(57) ABSTRACT

In a press forming machine for pressing a slide plate, which has a movable mold thereon, by using a plurality of driving sources, a control unit is disclosed, in which when offset load is applied on the slide plate, molding can be performed while the slide plate is maintained at a desired position relative to a fixed mold. In the press forming machine, engaging parts corresponding to the driving sources are provided on the slide plate, and displacement measuring units for measuring a displacement of the slide plate are provided near the engaging parts. The control unit includes a unit which measures a displacement of each of the driving sources by using the displacement measuring unit in each of a plurality of operating steps during a molding operation, detects a desired displacement position of the entire slide plate in each of the steps, extracts control data corresponding to the driving sources to maintain the entire slide plate at a desired displacement position, stores the control data in a memory, supplies the control data to the driving sources, and separately drives the driving sources. Since actual molding can be performed by using control data generated in a trial molding, it is possible to shorten cycle time of the actual molding.

33 Claims, 18 Drawing Sheets

PRESS FORMING MACHINE

BACKGROUND OF THE INVENTION

1. Field of the Invention

The present invention relates to a press forming machine used for molding a metal plate and so on and particularly to a press forming machine capable of maintaining a slide plate on which a movable mold is mounted at a desired position relative to a fixed mold.

2. Description of the Related Art

Press forming machines are used for punching press, drawing molding, die forging, injection molding, and so on. A press forming machine generally has one mold as a fixed mold and the other mold as a movable mold. A vertical press forming machine has a lower support stand, a plurality of columns supported by the lower support stand, an upper support plate held by the columns, and a slide plate which can reciprocate between the lower support stand and the upper support plate along the columns and has a molding space between the slide plate and the lower support stand. In the molding space, a fixed mold is provided on the lower support stand, a movable mold is provided on the lower surface of the slide plate, and a work piece is molded between the fixed mold and the movable mold. The slide plate is generally formed into a plane and is vertically moved by a driving mechanism. It is desirable to carry out molding while the movable mold is kept on a desired position relative to the fixed mold, for example, while the movable mold is kept horizontally and moved. Thus, the slide plate is moved while being kept horizontally, and the columns are formed with rigidity and a large thickness to prevent the slide plate from being inclined during molding. However, in some cases, distortion occurs on the slide plate and so on and inclination occurs due to a clearance between sliding parts. Thus, it has been necessary to correct the mold to compensate for the distortion and inclination.

The driving mechanism is mounted on the upper support plate, a drive shaft extends from the mechanism, and the tip of the shaft is engaged to the slide plate. A servomotor or a hydraulic cylinder is used as a driving source. In the case of a motor, the rotation of the motor is transformed to a vertical motion by a crankshaft and a cam and the rotation of the shaft is transformed to a vertical motion by a ball screw.

In some shapes of the work piece to be subjected to press forming, an offset load may occur on a mold, and a fixed mold and a movable mold or a slide plate may not stay horizontal to each other. Regarding a plurality of driving sources provided for driving the slide plate, the following proposal has been made: the slide plate is kept in a horizontal position by controlling the driving sources so as to maintain the synchronization among the plurality of driving sources.

However, since a work piece formed by press forming has a complicated shape such as a three-dimensional shape, force applied to the slide plate during molding is changed in the progress of the molding. Besides, a position where force is applied is shifted during the molding.

For example, FIGS. 18A, 18B, and 18C schematically show the state of reaction force applied to the slide plate when an oil pan for an automobile is formed by press molding. In these drawings, a slide plate 40 is indicated as x-y coordinates. For example, when molding is started, a cope initially reaches a drain of the oil pan and the drain is formed. Hence, force occurring thereon is applied to a fourth quadrant of the x-y coordinates. An oil dish is formed as the molding proceeds. Thus, large forces w2 and w3 are received from a second quadrant and a third quadrant of the coordinates. Force w1, which is originally applied, is reduced at this moment, and large force w4 on a first quadrant is added. Hence, composite force W is applied to the third quadrant. As the molding proceeds, the forces w2 to w4 decrease, force w5 is added, and composite force is applied to the right of y axis substantially on x axis.

The above application of forces and composite force, the magnitude of force, and the above changes in force may vary depending upon the shapes of the work piece and a traveling speed of the mold. The position and magnitude of the composite force, which is applied on the slide plate, is generally changed as the press forming proceeds.

As described above, the position where composite force is applied moves not only along a straight line but also in a biaxial direction, that is, on a plane when a work piece having a three-dimensional shape is molded.

When composite vertical force exerted to the slide plate is applied to the center, rotation moment for inclining the slide plate is not applied to the slide plate. Since the position where force is applied is moved as described above, the position and magnitude of rotation moment applied to the slide plate are also changed. Therefore, deformation occurring on the press forming machine is changed as the press forming proceeds. The deformation includes the extension and bending of the columns of the press forming machine and distortion of the slide plate, the upper support plate, and the fixed support plate during press forming.

In this manner, the application of load is changed as the press forming proceeds, and the extension and deformation on the parts of the press forming machine are also changed.

Conventionally, in order to minimize the extension and deformation on the parts of the press forming machine, that is, for example, in order to reduce the inclination and distortion of the slide plate, the slide plate increases in thickness with rigidity and the columns increase in thickness to reduce a gap between the slide plate and the columns. And then, when a plurality of driving sources is used to press the slide plate, a main driving source is driven according to a desired control style to move down the slide plate, and the other slave driving sources are driven while being controlled according to the descend of the main driving source.

The controlling method using the main driving source and the slave driving sources is a method for evenly pressing the entire of the slide plate (e.g., while being forcefully kept in a horizontal position) while the rigidity of the slide plate is made sufficiently large. This method is effective for a large press forming machine.

However, when distortion on the parts of the slide plate and other parts of the machine needs to be considered, in the method for performing driving while controlling the slave driving sources according to the main driving source, in view of the above-mentioned distortion, it is extremely difficult to allow the slave driving sources to follow the main driving source such that the distortion is eliminated. Further, even when the above-mentioned method is possible, in view of control exercised by a computer when the main driving source and the slave driving sources are controlled, a processing amount of the computer is extremely large, so that it is necessary to install a high-speed computer.

SUMMARY OF THE INVENTION

An object of the present invention is to provide a press forming machine which can separately drive driving sources so as to always maintain a movable mold at a desired position relative to a fixed mold when press forming proceeds.

Another object of the present invention is to provide a press forming machine whereby when the same kind of work piece is repeatedly subjected to press forming, control data corresponding to driving sources is previously stored in a memory of control means in each of a plurality of operating steps, and the driving sources are driven separately in an asynchronous manner according to the stored control data during press forming so as to perform desired molding.

As a result, molding time can be shortened in the case of repeated molding. Even when a CPU of the control means is relatively slow in processing speed, the driving sources can be controlled, thereby reducing molding time.

A press forming machine of the present invention comprises:

a lower support stand, an upper support plate held by a plurality of columns supported by the lower support stand, a slide plate which can reciprocate between the lower support stand and the upper support plate and has a molding space between the slide plate and the lower support stand, a plurality of driving sources, and control means for controlling driving each of the driving sources.

Each drive shaft of the driving sources is engaged to the upper surface of the slide plate to make a displacement of the slide plate. The control means comprises a memory for storing control data, which provides a positional displacement of each of the driving sources, for each of the driving sources in each of a plurality of operating steps during a molding operation, and means which supplies control data stored in the memory corresponding to each of the driving sources and separately drives the driving sources.

The driving sources are preferably located such that pressure applied by the plurality of driving sources is evenly distributed on the slide plate. Further, it is preferable to use driving sources which can generate an equal pressure in every unit of control data. When the same number of driving signal pulses is inputted to the driving sources, it is preferable for driving sources to exert equal driving forces, that is, each has similar specifications.

Or in the press forming machine, engaging parts corresponding to the driving sources are provided on the slide plate, displacement measuring means, which measure a displacement according to a positional change of the slide plate, are disposed near the engaging parts, and control means is provided for controlling driving of the driving sources. The control means preferably comprises means which measures a positional displacement of each of the driving sources by using the displacement measuring means in each of the plurality of operating steps during the molding operation, detects a desired displacement position of the entire slide plate in each step, extracts or generates control data corresponding to the driving sources in order to maintain the entire slide plate in the desired displacement position, stores the control data in the memory, supplies the control data to the driving sources, and separately drives the driving sources. When it is preferable to drive the slide plate while maintaining the slide plate in a horizontal position, control data corresponding to the driving sources can be extracted and generated such that the slide plate is horizontal in each step, as a desired displacement position of the entire slide plate.

When actual molding is repeated after trial molding, the control means may comprise means which supplies to the driving sources control data corresponding to the driving sources in each of a plurality of operating steps during the actual molding operation and which separately drives the driving sources, the control data being obtained so as to maintain the entire slide plate in a desired position in each of a plurality of operating steps during the trial molding operation.

The control means preferably comprises means which detects a desirable displacement position of the entire slide plate by using the displacement measuring means in each of a plurality of operating steps during the trial molding operation and extracts the control data corresponding to the driving sources to maintain the entire slide plate at the desired displacement position.

DETAILED DESCRIPTION OF THE PREFERRED EMBODIMENTS

Figure 1:
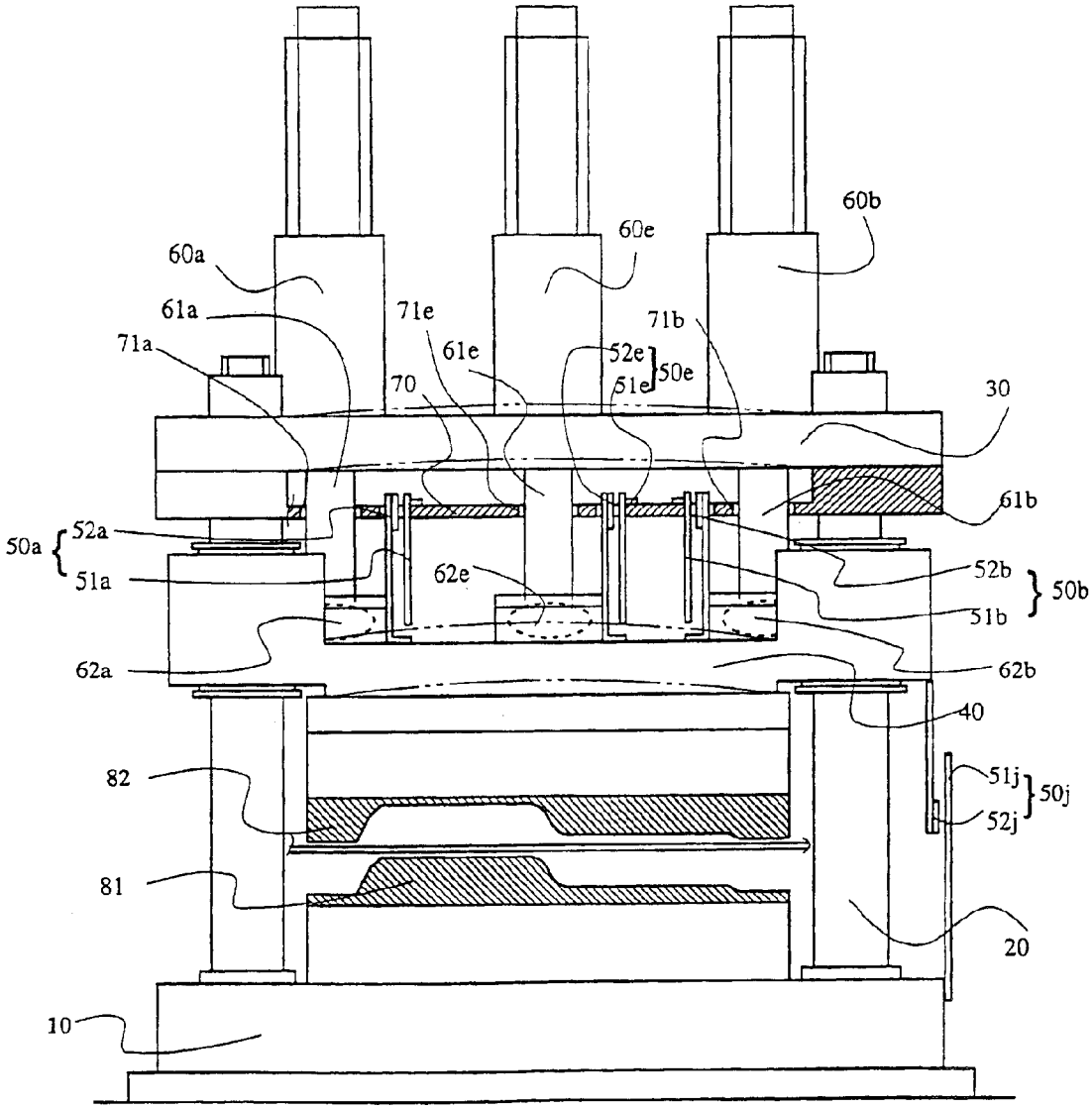
FIG. 1 is a front view showing an example of a press forming machine which can be used for the present invention.
Figure 2:
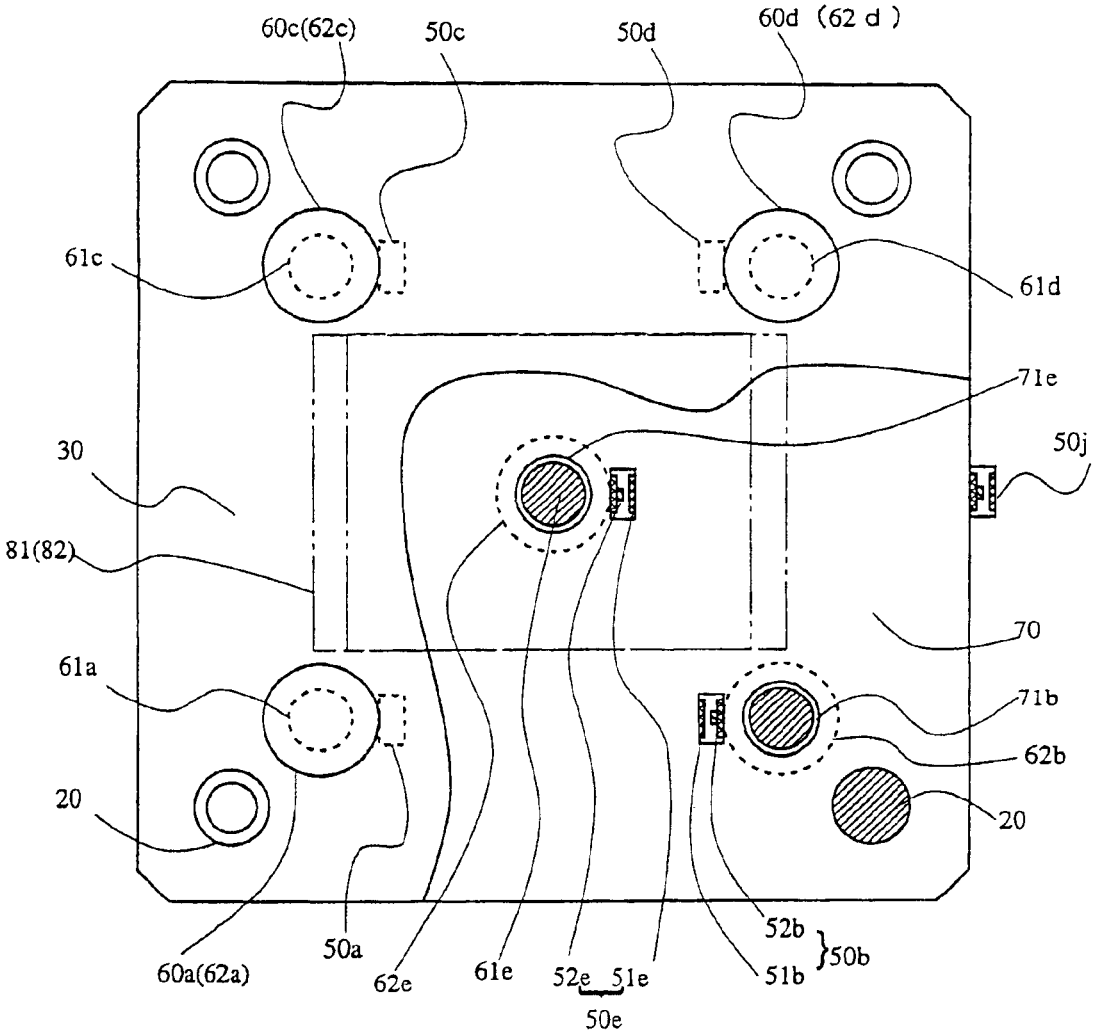
FIG. 2 is a plan view showing the press forming machine of FIG. 1 with an upper support plate being partially removed.

First, referring to FIGS. 1 and 2, the following will discuss an example of a press forming machine used for the present invention. FIG. 1 is a front view of the press forming machine, and FIG. 2 is a plan view of the press forming machine. In FIG. 2, an upper support plate is partially removed. In the press forming machine, a lower support stand 10 is fixed on a floor, and an upper support plate 30 is held by columns 20 set up on the lower support stand. A slide plate 40, which can reciprocate along the columns 20, is provided between the lower support stand 10 and the upper support plate 30, and a molding space is provided between the slide plate and the lower support stand. In the molding space, a fixed mold (drag) 81 for pressing is provided on the lower support stand, and a movable mold (cope) 82 corresponding to the fixed mold is provided on the lower surface of the slide plate. For example, a plate to mold is placed between the molds to carry out molding. A displacement measuring means 50*j* is provided between the slide plate and the lower support stand to measure the position of the slide plate 40 relative to the lower support stand 10. Although FIGS. 1 and 2 show only a single displacement measuring means 50*j*, a plurality of displacement measuring means may be provided. As the displacement measuring means, means is applicable which has a magnetic scale 51*j* with magnetic scales and a magnetic sensor 52*j* such as a magnetic head, which is opposed to the magnetic scale with a small gap. The magnetic sensor 52*j* is moved relative to the fixed magnetic scale 51*j* so as to measure an absolute position, a displacement speed, and so on. Such displacement measuring means has been well known as a linear magnetic encoder to a person skilled in the art, so that further explanation is omitted. As the displacement measuring means, a means for measuring a position by light or an acoustic wave is also applicable.

Five sources are provided as driving sources 60*a*, 60*b*, 60*c*, 60*d* and 60*e*, each combining a servomotor and a speed reducing mechanism on the upper support plate 30. Drive shafts 61*a*, 61*b*, 61*c*, 61*d* and 61*e*, which extend downward from the driving sources, pass through through-holes 71*a*, 71*b*, . . . , 71*e*, which are formed on a reference plate 70, and are engaged to engaging parts 62*a*, 62*b*, . . . , 62*e* on the upper surface of the slide plate 40. For example, ball screws are placed on the drive shafts to transform the rotation into vertical motion, and the slide plate is vertically moved by the rotation of the servomotor. A driving mechanism is constituted by the driving sources, the drive shafts and the engaging parts.

It is preferable to locate the driving sources such that pressure applied to the plurality of driving sources 60*a*, 60*b*, 60*c*, 60*d* and 60*e* is evenly distributed to the slide plate. Further, it is preferable that the driving sources generate equal pressures, that is, the outputs of the driving sources are equal.

As shown in the plan view of FIG. 2, the engaging parts 62*a*, 62*b*, 62*c* and 62*d* surround a molding region of the molding space, and the engaging part 61*e* is located, for example, at the center of the molding region. Moreover, each of displacement measuring means 50*a*, 50*b*, 50*c*, 50*d* and 50*e* is provided near each of the engaging parts 62*a*, 62*b*, 62*c*, 62*d* and 62*e*. As the displacement measuring means 50*a*, 50*b*, 50*c*, 50*d* and 50*e*, means similar to the displacement measuring means 50*j* is applicable. The means 50*j* is located on the right of the press forming machine. Magnetic scales 51*a*, 51*b*, . . . , 51*e* of the displacement measuring means 50*a*, 50*b*, 50*c*, 50*d* and 50*e* are provided on the reference plate 70, and magnetic sensors 52*a*, 52*b*, . . . , 52*e* are supported by columns placed on the engaging parts 62*a*, 62*b*, 62*c*, 62*d* and 62*e*. Here, the reference plate 70 is held at the same position regardless of the position of the slide plate 40. Thus, when the slide plate 40 is driven by the action of the driving sources 60*a*, 60*b*, 60*c*, 60*d* and 60*e*, the displacements of the engaging parts can be measured by the displacement measuring means 50*a*, 50*b*, 50*c*, 50*d* and 50*e*.

In FIG. 1, the reference plate 70 is provided under the upper support plate 30 via an interval and is fixed over the columns 20, and the reference plate 70 has the through holes 71*a*, 71*b*, . . . , 71*e* with sufficient diameters on the parts having the drive shafts 61*a*, 61*b*, . . . , 61*e*, so that the reference plate is not affected by deformation on the drive shafts and the slide plate. In the case of some shapes of the work piece, the upper support plate 30 and the slide plate 40 may be deformed as indicated by a chain double-dashed line of FIG. 1 as molding proceeds. However, since the reference plate 70 is supported only by the columns 20 on the both sides, the reference plate maintains a reference position regardless of deformation on the slide plate and the upper support plate.

Figure 8:
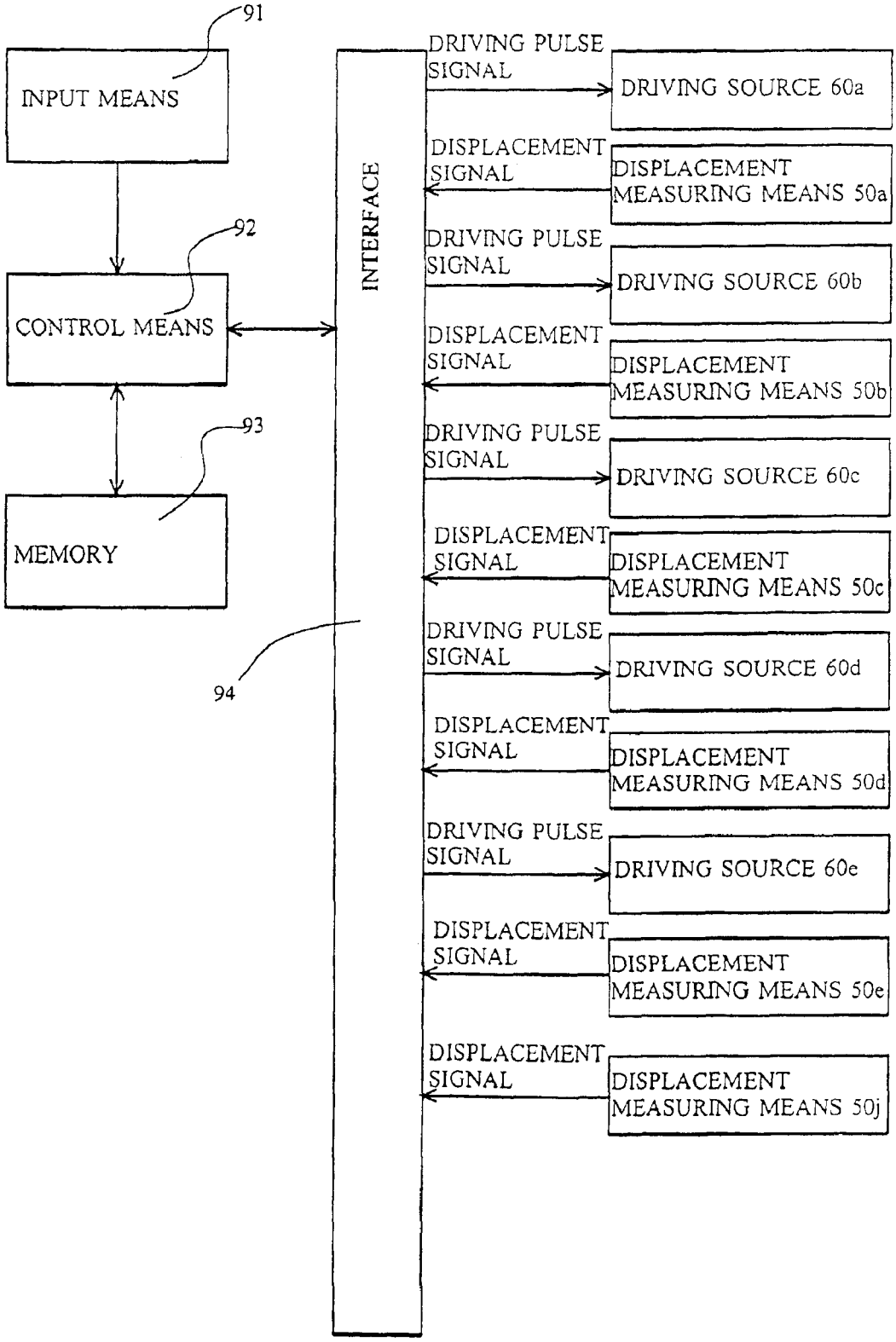
FIG. 8 is a diagram showing a control system of the press forming machine of the present invention.

FIG. 8 shows a control system of the press forming machine. Before molding, for example, a product name to be molded, a molding pressure, and molding time are previously inputted to control means 92 from input means 91 as necessary. The control means 92 has a CPU, and driving pulse signals are transmitted to the driving sources 60*a*, 60*b*, 60*c*, 60*d* and 60*e* from the control means 92 via an interface 94, and molding is carried out by driving the driving sources. A displacement signal of the slide plate is transmitted to the control means 92 from the displacement measuring means 50*a*, 50*b*, 50*c*, 50*d*, 50*e* and 50*j*.

As molding proceeds, force applied to the slide plate is changed as described in FIG. 18. Loads applied to the driving sources 60*a*, 60*b*, 60*c*, 60*d* and 60*e* are varied according to the force change. The fixed mold and the parts of the movable mold that correspond to the driving sources become irregular in positional relationship. Some parts quickly press down the slide plate 40, or other parts slowly press down the slide plate 40. The advance and delay in the slide plate are measured by the displacement measuring means 50*a*, 50*b*, 50*c*, 50*d*, 50*e* and 50*j* and are transmitted to the control means 92 so as to adjust a driving pulse signal transmitted to the driving sources 60*a*, 60*b*, 60*c*, 60*d* and 60*e* such that displacements of the displacement measurement means 50*a*, 50*b*, 50*c*, 50*d*, 50*e* and 50*j* are set at desirable values, that is, the slide plate is made horizontal on the parts of the engaging parts.

In this manner, when a work piece is molded, control data, which includes driving pulse signals supplied to the driving sources, is stored in a memory from the control means in each of a plurality of operating steps. The plurality of operating steps may include elapsed time from the start of press forming, a descending distance of the slide plate, or the order of molding from the start of press forming. For example, when the slide plate descends, time until the movable mold starts to press the molded plate or a moving distance until the movable mold starts to press the molded plate is designated as a first operating step. Thereafter, when the molding is started, since control data largely changes, short elapsed time periods or short descending distances (small displacements) are each designated as operating steps.

Next, control in molding will be discussed. At this moment, driving pulse signals are supplied to the driving sources, the slide plate is moved downward, and molding is started. When a movable mold 82 has a molded plate with a fixed mold 81 and makes contact with a most protruding part of the mold to start molding of the molded plate, the reaction force is applied to the slide plate. The same numbers of driving pulse signals are supplied to each of the driving sources. However, when the application of reaction force is started, the application of loads to the driving sources becomes uneven. Thus, the driving source receiving a larger load has a larger resistance, thereby reducing a descending displacement speed. Conversely, a descending displacement speed does not change or a displacement may relatively increase on the part of the slide plate that corresponds to the driving source on a part having a lighter load. Such displacements are measured by the displacement measuring means disposed near the parts of the slide plate, and measured values are sent to the control means 92. The control means 92 adjusts the numbers of driving pulse signals supplied to each of the driving sources so as to return the slide plate substantially to a horizontal position. The adjusted driving pulse signals are stored in a memory 93 for each of the driving sources, together with displacements or time in each of the operating steps.

Figure 3:
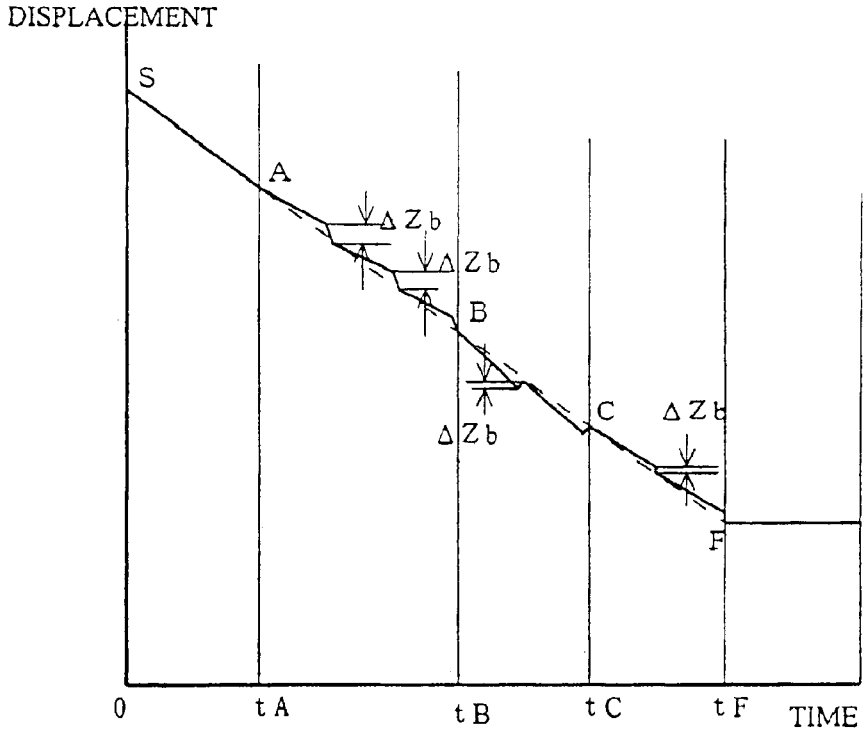
FIG. 3 is a graph showing displacements of a slide plate of the press forming machine relative to time.

FIG. 3 is an explanatory drawing, in which the position of the slide plate, for example, a positional change near the driving sources is indicated on the vertical axis and molding time is indicated on the lateral axis. In FIG. 3, the start of molding is denoted as S and the end of molding is denoted as F. A dotted line connecting S and F is an ideal molding line (command value), which is a traveling line approximately corresponding to command values of the slide plate entirely shifted downward. A measured value of the displacement measuring means 50*b* near the driving source 60*b* is indicated by a thick line. Since the slide plate descends horizontally until a load is applied, a straight line is obtained from S to A. A heavy load is applied from A, the driving source receives a large resistance, so that deformation occurs and displacement is delayed in time around a part of the press forming machine where a load is applied, resulting in a relatively larger distance from the fixed mold than the other parts. Thus, travelling is delayed by ΔZb from an average traveling line per elapsed time. The delay in displacement is measured by the displacement measuring means 50*b* near the above part of the slide plate, and a measured value is transmitted to the control means 92. The control means 92 transmits driving pulse signals to the driving source 60*b* more than to the other driving sources such that the slide plate returns to a desired displacement. The above operation is repeated so as to have the same displacement as the other parts at, for example, position B.

After the position B of FIG. 3, a load applied on the driving source 60*b* is reduced. Hence, traveling is faster by ΔZb from the average traveling line per elapsed time. Thus, the control means 92 transmits fewer driving pulse signals to the driving source 60*b* such that the slide plate has a desired displacement. Such adjustment is repeated until the molding end F. Since the same control is exercised on the other driving sources, molding can be performed while the slide plate is entirely maintained at a desired displacement position. As a result, it is possible to prevent the occurrence of rotation moment on the slide plate during molding.

Such a driving pulse signal is shown in TABLE 1. Time fields of TABLE 1 correspond to molding times of FIG. 3, and a predetermined pulse indicates an average number of pulses required in each molding time period. Thus, the driving source 60*b* receives n0 driving pulse and travels to A from time 0 to tA. The other driving sources travel in the same manner. The driving source 60*b* receives nA driving pulse signals from time tA to tB, and delay of ΔZb appears in each predetermined time period. Thus, it is necessary to additionally receive a driving pulse signal of ΔnAb. And then, regarding the driving source 60*b* from tB to tC, the number of pulses can be smaller than a predetermined amount of pulse nB by ΔnBb. Further, from tC to tF, the number of pulses needs to be larger than a predetermined amount nC by ΔnCb.

TABLE 1

| TIME | PREDETERMINED PULSE NUMBER | DRIVING SOURCE 60a | DRIVING SOURCE 60b | . . . | DRIVING SOURCE 60e |
|---|---|---|---|---|---|
| 0 to tA | n0 | n0 | n0 | . . . | n0 |
| tA to tB | nA | nA − ΔnAa | nA + ΔnAb | . . . | nA + ΔnAe |
| tB to tC | nB | nB − ΔnBa | nB − ΔnBb | . . . | nB + ΔnBe |
| tC to tF | nC | nC + ΔnCa | nC + ΔnCb | . . . | nC − ΔnCe |

As described above, in such an initial or a plurality of times of trial molding, a displacement of the driving source (or a part of the slide plate near the engaged driving source) is measured by the displacement measuring means corresponding to the driving source in each operating step, and driving pulse signals supplied to the driving sources are controlled to maintain values measured by the displacement measuring means at desired displacement positions. During the trial work molding, driving pulse signals supplied to the driving sources are stored in the memory as a control data table in each operating step. Thus, the control data table shown in TABLE 1 is stored.

When a work piece is molded in a press forming machine, the same kind of work pieces are normally molded in a repeated manner. Thus, during the actual molding for the same kind of work pieces, the kind of work pieces are specified by the input means 91 and so on to call up the content of the control data table, which is stored in the memory. The control means 92 activates the driving sources 60*a* to 60*e* according to the content of the control data table via the interface 94, so that the work pieces can be molded while the slide plate is maintained at a desired displacement position.

When the same kind of work pieces are molded repeatedly, the cycle time can be shorter than that of the trial work molding for forming the control data table. For example, 10 seconds of cycle time of the trial work molding can be gradually shortened to, for example, an extremely short cycle time of one second in the actual molding after several trials. The cycle time is shortened by reducing the time interval of the driving pulse, eliminating the interval between an operating step and the subsequent step, or performing direct control using control data.

When the control data table is formed by the trial work molding, it is preferable that the driving sources are moved as slowly as possible to slowly move the slide plate and the movable mold. Since impact during molding causes vibration or a load during molding causes deformation on the press forming machine to produce vibration, driving is preferably performed after time for reducing the vibration within a permissible range. The delay can maintain and improve the accuracy of displacements measured by the displacement measuring means. Moreover, as the CPU included in the control means, a CPU with a relatively slow processing speed is also applicable for producing the control data.

In the actual work molding according to the control data table, it is preferable to shorten the cycle time. Thus, during trial molding, the time intervals of the driving pulses are successively reduced to shorten the cycle time. In trial molding which successively use shorter driving pulses, it is confirmed that the slide plate is maintained at a desired position by the displacement measuring means. The number of driving pulses is adjusted and corrected as necessary to remake the control data table of TABLE 1.

The control data table is formed with a shorter cycle time after several times of trial molding. Thus, by performing actual molding according to the corrected control data table, molding can be performed in a short time while the movable mold and the fixed mold are maintained at desired positions. In the actual molding, the driving sources are operated by control data, so that it is not necessary to use all the displacement measuring means for measurement. At some positions having the displacement measuring means, interference with a work handling operation may occur in an actual operation. Thus, before a pressing operation, it is also possible to remove the displacement measuring means that may cause the interference.

Further, the dimension of the press forming machine may be affected by a temperature increased by an ambient temperature and heat liberation of the press forming machine. Thus, in the case of repeated molding, trial molding is performed at least once every day or in each of several hundreds times of molding, and in the trial molding, the content of the control data table can be confirmed or corrected while the position of the slide plate is measured by the displacement measuring means.

Besides, in the press forming machine shown in FIGS. 1 and 2, the displacement measuring means 50*a* to 50*e* are provided near the driving sources 60*a* to 60*e* to measure a displacement relative to the reference plate 70. Only the displacement measuring means 50*j* can measure a displacement of the slide plate 40 relative to the lower support stand 10. When the columns 20 has small or little extension during molding, it is only necessary to measure a displacement position relative to the reference plate 70 attached to the columns 20.

Figure 4:
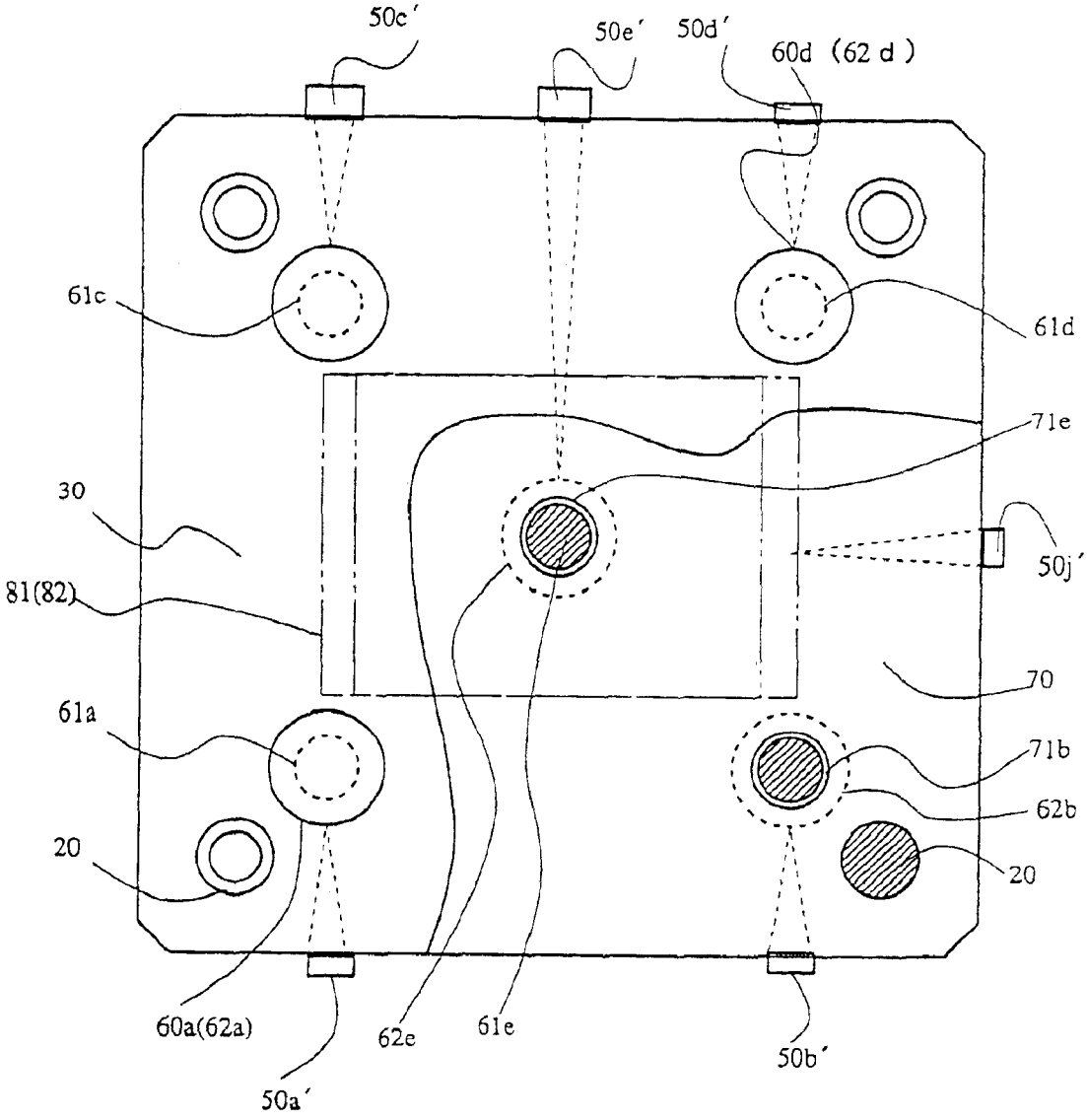
FIG. 4 is a plan view showing that displacement measuring means are changed in the press forming machine of FIG. 1.

However, when a displacement needs to be measured more accurately or in order to avoid an error caused by the extension of the columns 20, as shown in FIG. 4, it is more preferable to optically measure a position while the displacement measuring means 50*a*' to 50*e*' and 50*j*' are provided outside the press forming machine.

The above explanation mainly discussed that the movable mold stays horizontal to the fixed mold. Some kinds of work piece and press forming machine may require diagonal molds. Thus, "a desired displacement position" is used.

In the above description, in the trial press forming, a driving amount, for example, the number of control pulse signals is extracted such that the slide plate, that is, the movable mold maintains a desired position relative to the fixed mold in each of a plurality of operating steps of the progress of molding, the driving amount is stored as a control data table in the memory, and the driving sources are driven according to the control data table during the actual molding. The concept of the present invention can be changed as follows: for example, when a plurality of similar press forming machines are provided and the same type of product is molded by the same type of mold, trial molding is performed by one of the press forming machines to produce a control data table. And then, the control data table is used by another press forming machine among the above-mentioned press forming machines to perform actual molding. In another case, a control data table is obtained by virtual press forming using a data processing system and so on, and then, the control data table is used for an actual press forming machine to perform molding.

Figure 5:
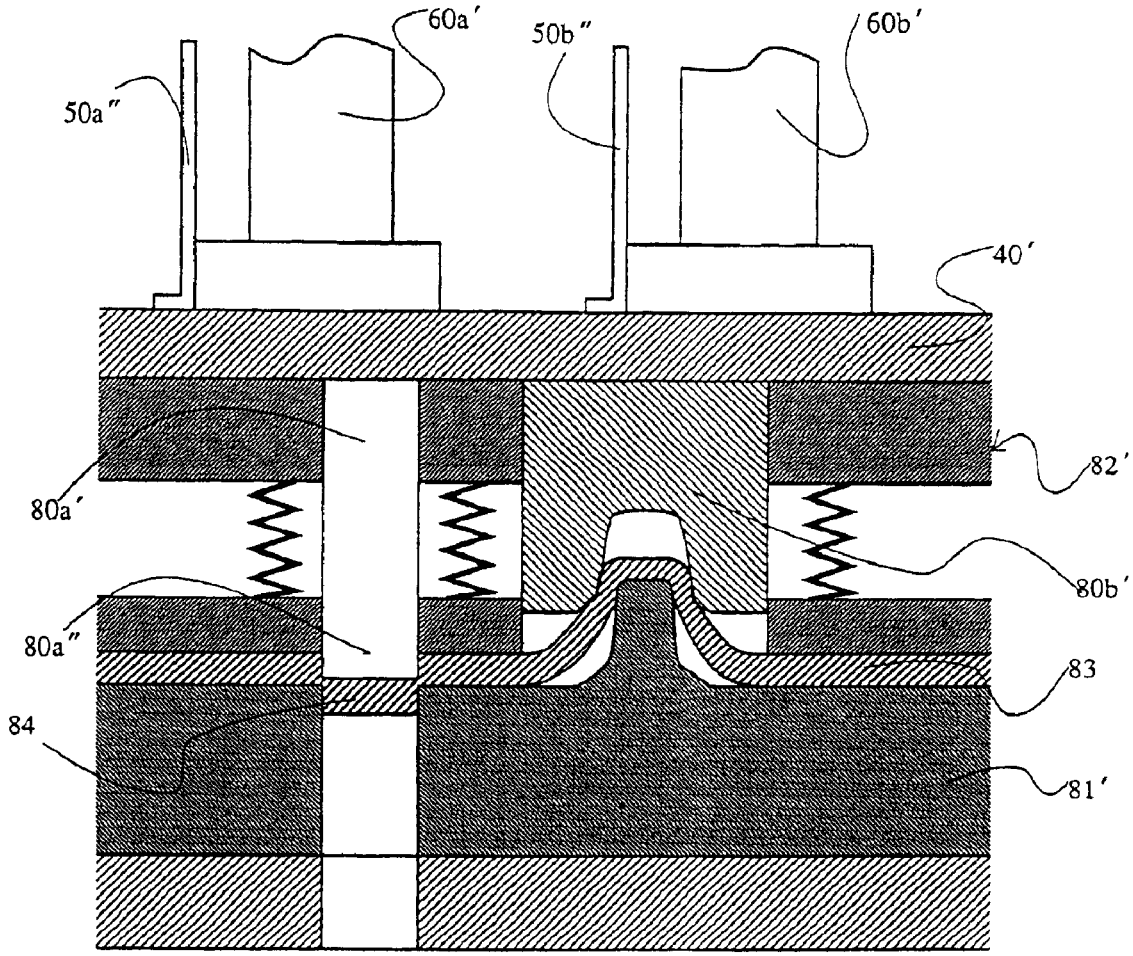
FIG. 5 is a sectional view showing a mold of a press forming machine which can be used as another example of the present invention.
Figure 6:
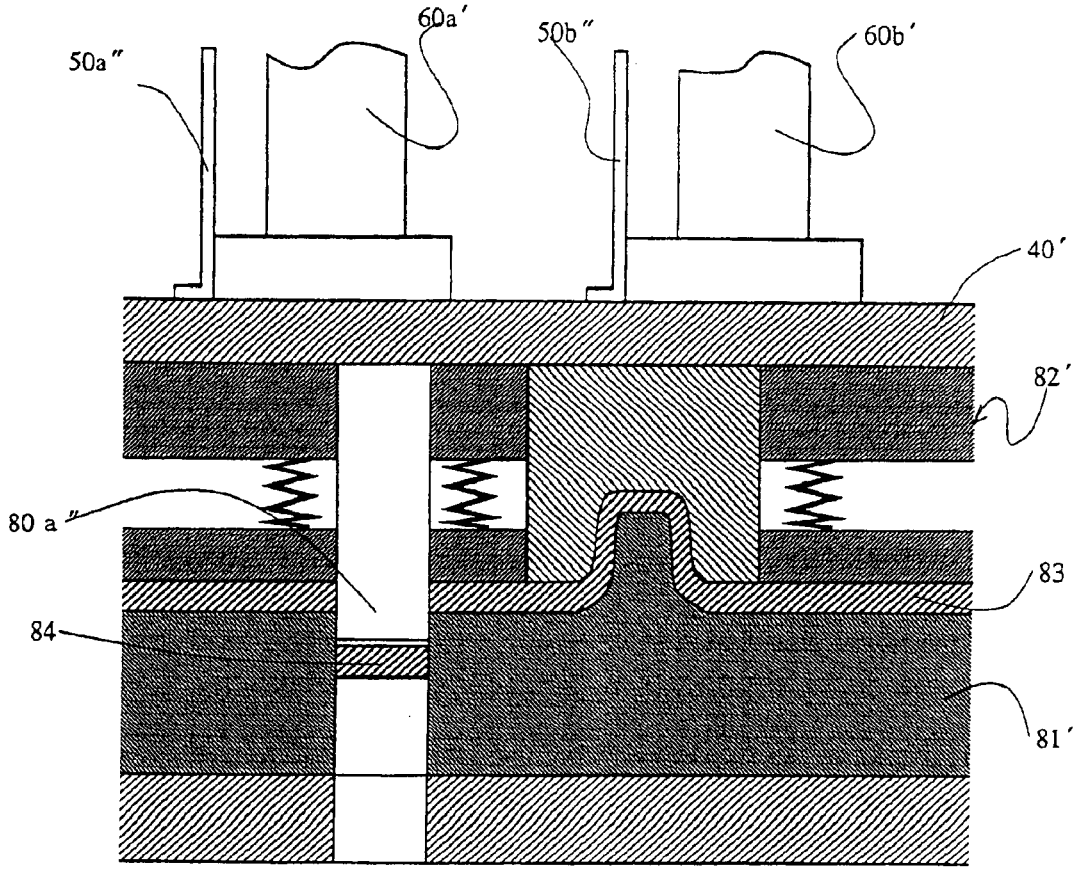
FIG. 6 is a sectional view showing the mold at a displaced position from FIG. 5.

As another example of the present invention, a forming die having a punched part 80*a*' and a bent part 80*b*' is shown in the sectional views of FIGS. 5 and 6. A movable mold 82' of the forming die is disposed on the lower surface of a slide plate 40'. Driving sources 60*a*' and 60*b*' and displacement measuring means 50*a*" and 50*b*" are disposed respectively on the upper surface of the slide plate. Further, displacement measuring means (not shown) for measuring the position of the entire slide plate 40' is provided as shown in FIGS. 1 and 2. A punch 80*a*" provided on the punched part 80*a*' of the movable mold 82' protrudes downward lower than the bent part 80*b*', and bending is performed after punching is performed on a metal plate 83 to mold.

Punching proceeds until the state of FIG. 5, the punch 80*a*" further descends to cut off a punched member 84 as shown in FIG. 6. Before the punched member 84 is cut off, the movable mold 82' travels with a relatively low speed, and when the punched member 84 is cut off, the movable mold 82' travels faster again to perform cutting and bending after the release of a load, which has been applied until that moment.

When punching is performed in this manner, at the moment of cutting off, energy which has pressed the slide plate is released all at once, so that the slide plate descends largely. Until the state of FIG. 5, surely the cutting off and press forming proceed in parallel.

Including such a moment for releasing energy, as discussed in FIG. 3, over the period of trial work molding, desirable movements of the slide plate (that is, desirable control data for the driving sources) are collected as discussed in the above TABLE 1 and are used for actual work molding. In this case, it is extremely difficult to correctly control the movement of the slide plate before and after the cutting off.

Therefore, in the present invention, the slide plate is slightly returned upward such that pressing energy is released once just before the above cutting off, desired control data until this moment is collected, and then, control data is collected which corresponds to the desirable movement of the slide plate just after the cutting off. Moreover, in the present invention, in the actual work molding, work molding is performed by using control data divided into two steps.

Figure 7:
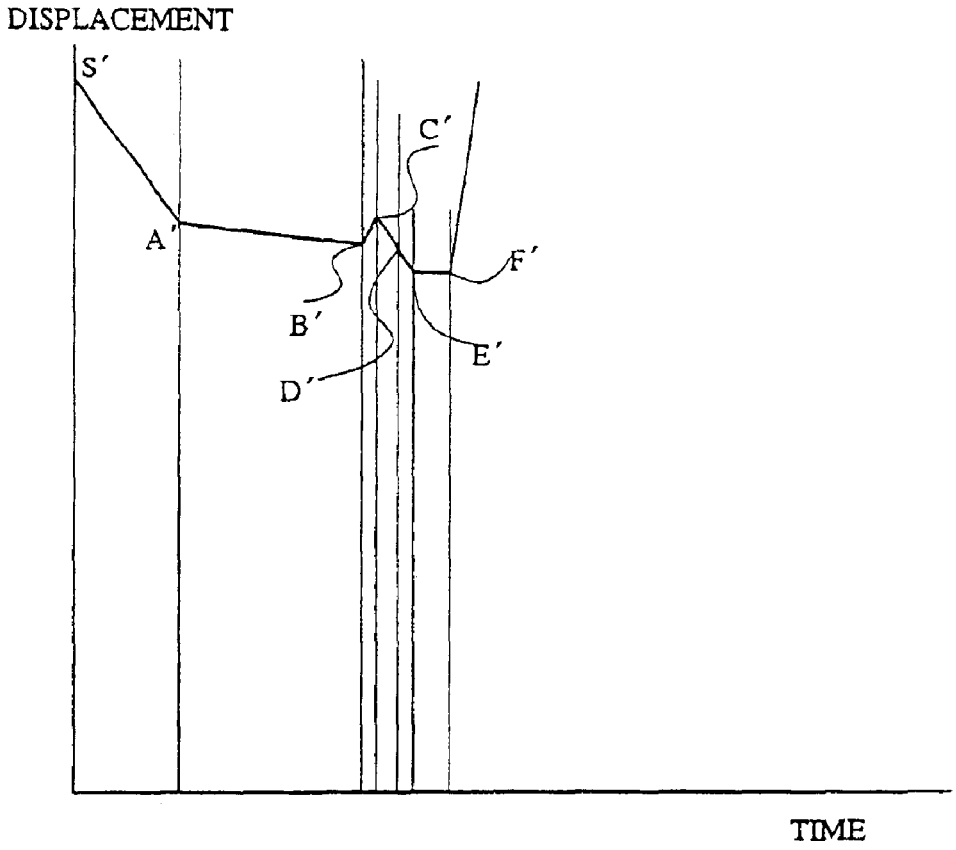
FIG. 7 is a graph showing displacements of a slide plate of the press forming machine shown in FIGS. 5 and 6 relative to time.

FIG. 7 shows the relationship between a displacement and molding time of the slide plate 40' in the press forming machine of this example. The molding operation is divided into punching S' to C' (partially including molding) and bending C' to F'. The punching is further divided into an operating step of from S' to A' in which the movable mold 82' descends from S' and the punch 80*a*" presses the molded plate, an operating step of from A' to B' in which the punch 80*a*" punches off the molded plate 83 just before the punched member 84 is cut off, and an operating step of from B' to C' in which the punch 80*a*" is slightly returned to release accumulated energy when the punch 80*a*" presses down just before the cutting off.

As shown in FIG. 7, it is preferable to change a moving speed of the movable mold 82' or the slide plate 40', from S' to A', from A' to B', and from B' to C'. Between S' and A', the entire of the movable mold 82' is not in contact with the plate 83 to mold or the fixed mold 81', and reaction force is hardly applied on the slide plate from S' to A'. Thus, the control means quickly moves down the slide plate 40'. During this period, the slide plate can be entirely kept at a desired displacement position without control by supplying an equal number of driving pulses to all of the driving sources. Between A' and B', the slide plate is slowly moved down. Since large reaction force is applied on the punch 80*a*", in the same manner as the previous example, a large number of driving pulses are supplied to the driving source 60*a*' disposed above the punch 80*a*", so as to compensate for displacement delay of the displacement measuring means 50*a*" such that the slide plate is entirely maintained at a desired displacement position. At point B", the driving source is slightly retracted to release force applied to the slide plate 40'. It is preferable to position point B' just before the start of breakthrough, that is, at about 10 to 15% of a plate thickness.

Thereafter, the slide plate 40' is moved down again to cut off the plate. After the cutting off, bending is completed from D' to E'. A pressure can be also maintained from E' to F'. And then, the slide plate is returned. Bending is actually performed between C' and E'. Control data corresponding to the driving sources is extracted so as to maintain the entire slide plate at a desired displacement position between C' and E'. Namely, the control means supplies driving pulse signals to the driving sources such that the slide plate entirely has desired displacements.

In the above example, just before the member to punch is cut off by punching, that is, when punching proceeds, bending is performed on the slide plate after accumulated energy is released. In this manner, since accumulated energy is released, accumulated energy is extremely small during bending and accurate working can be performed with small deformation on the mold. Further, it is possible to reduce sound and vibration during working.

With the molding cycle of from S' to F', a control data table is stored in the memory as shown in TABLE 1. The control data is preferably divided into two or more stages including the two stages of punching of from S' to C' and bending of from C' to F'. When the same kind of work piece is repeatedly molded, molding can be performed according to the control data table. Further, when the molding cycle is shortened, in accordance with the above-mentioned example, trial molding is performed with shorter cycle time for several times to correct the control data table.

In the present invention, as discussed in the present example, it is also possible to divide the control stage of the press forming machine to change the relationship between displacement and time according to punching and molding.

Figure 9:
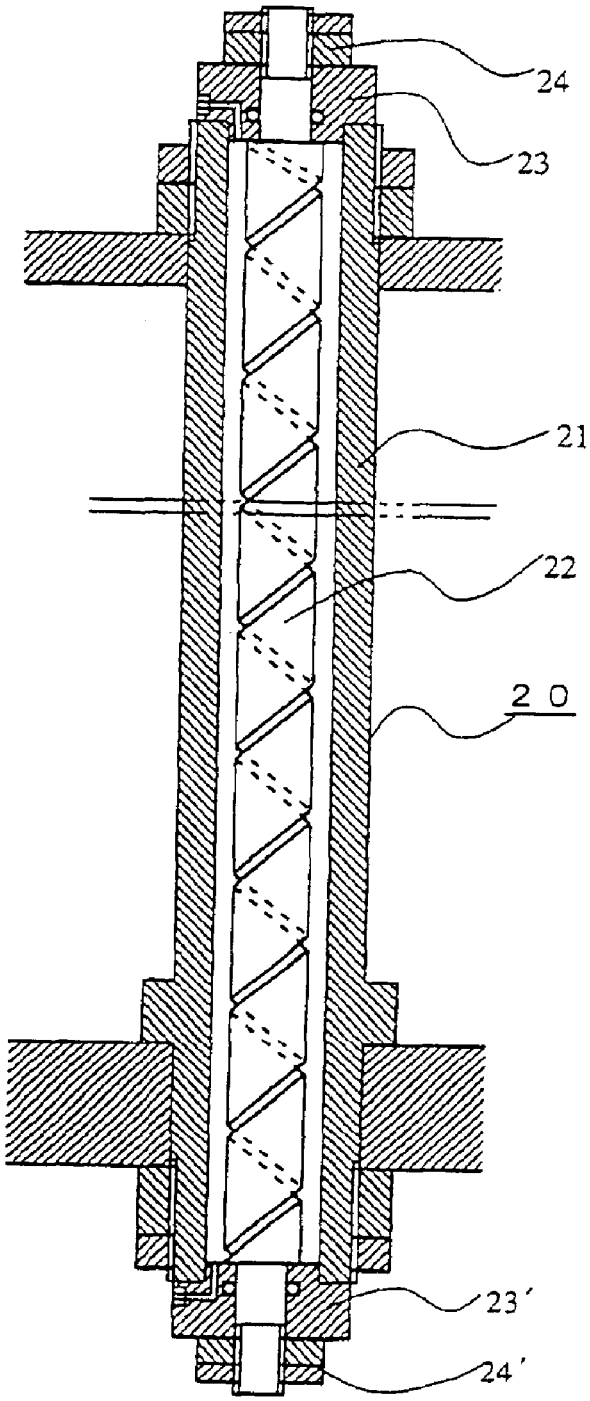
FIG. 9 is a sectional view showing a guide axis preferably used for the press forming machine of the present invention.

A sectional view of FIG. 9 shows a preferable configuration of the column 20 used in the press forming machine of the present invention. The periphery of the column is a sleeve 21 made of steel. At the center of the column, a tight bar 22 made of steel is attached by tightening nuts 24 and 24' via upper and lower pressing plates 23 and 23'. Thus, compressive stress is applied on the sleeve 21 and tensile stress is applied to the tight bar 22. Cooling oil can be applied between the tight bar 22 and the sleeve 21 so as to suppress heat liberation occurring on bearings when the slide plate moves vertically.

With such a configuration of the column 20, thickness can be smaller because rigidity can be increased. Further, a temperature increase can be reduced so as to obtain accurate movement.

Figure 10A:
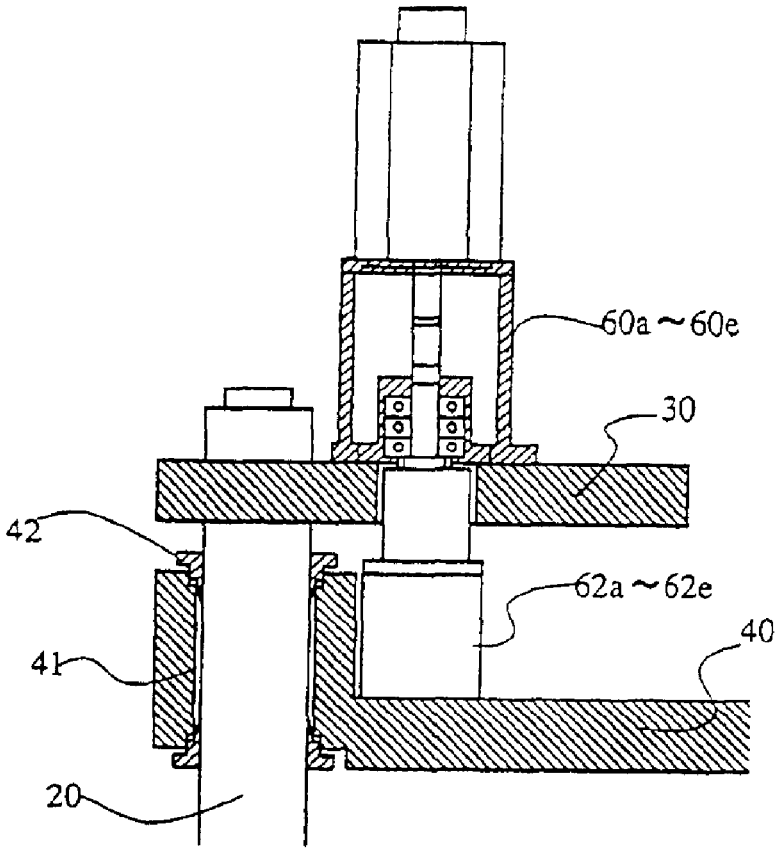
FIG. 10A is a vertical sectional view showing the detail of a bearing of the slide plate and the guide axis in the press forming machine of the present invention.
Figure 10B:
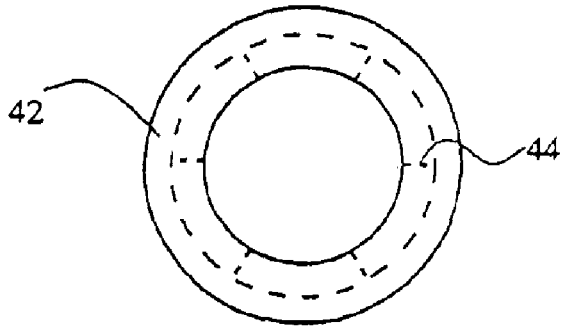
FIG. 10B is an enlarged plan view showing an adjustment sleeve used on the bearing.
Figure 10C:
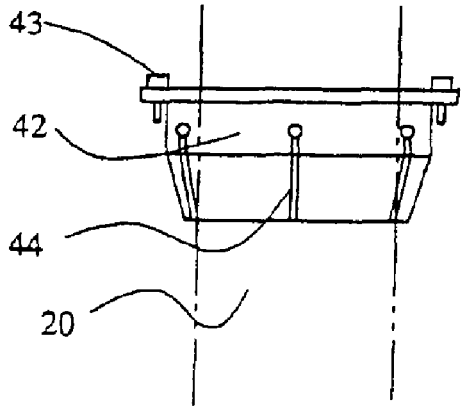
FIG. 10C is a side view showing the adjustment sleeve.

Besides, FIGS. 10A, 10B, and 10C show a suitable bearing between the column 20 and the slide plate 40 in the press forming machine of the present invention. FIG. 10A is a sectional view showing the entire configuration of the bearing. FIG. 10B is a plan view showing an adjustment sleeve. FIG. 10C is a side view showing a state in which the adjustment sleeve is attached to the column. An through-hole 41 of the slide plate 40 is a cylinder having a gap with the column 20, and adjustment sleeves 42 with tapered sectional views are attached to the top and bottom of the air bent 41 by tightening adjustment bolts 43. The adjustment sleeves 42 have vertical kerfs 44 on the tapered parts, so that tightening can be adjusted by tightening of the adjustment bolts 43. With the above configuration, the gap can be increased when the slide plate is operated fast and the gap can be reduced in precision pressing.

Figure 11:
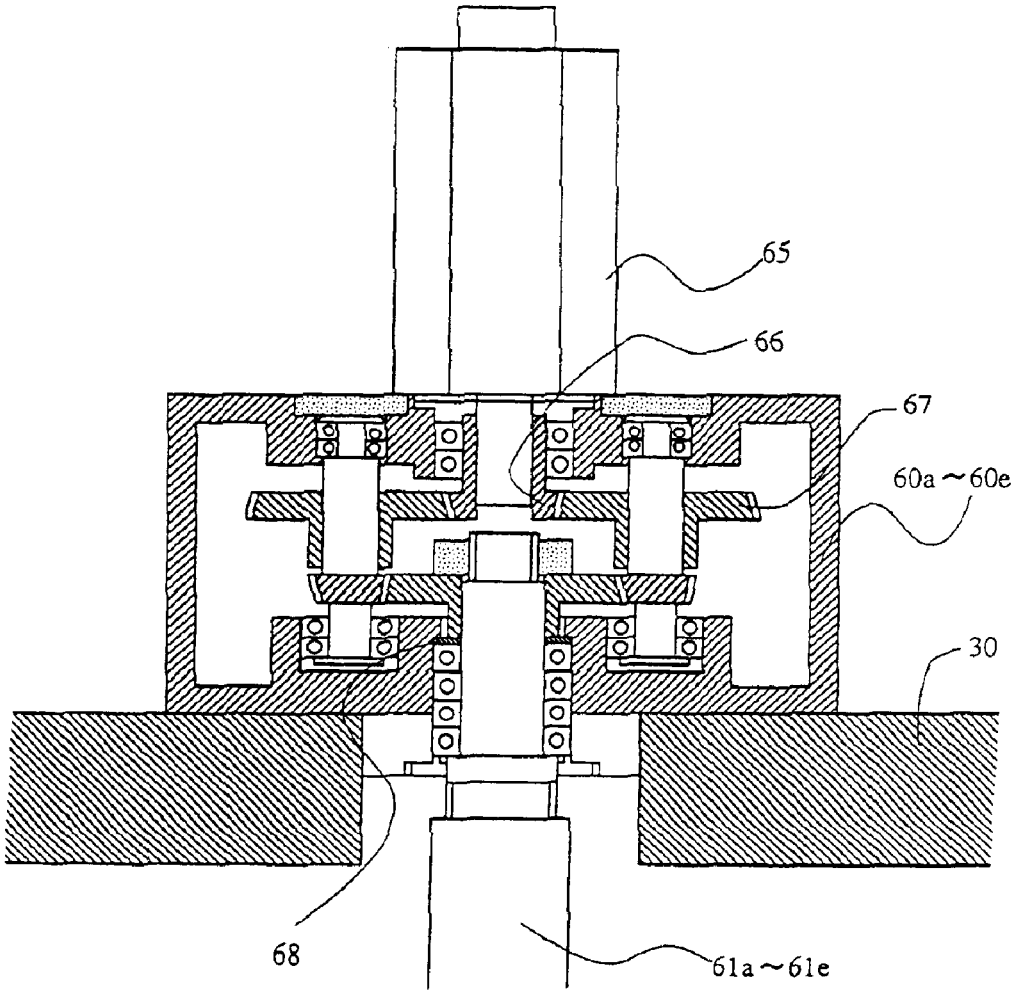
FIG. 11 is a vertical sectional view showing an enlarged speed reducing mechanism in the press forming machine of the present invention.

FIG. 11 shows the speed reducing mechanism suitable for the driving sources 60*a* to 60*e*. For example, a helical face gear 66 is used as a rotation axis of the servomotor 65. Helical pinion gears 67 are used on the right and left of the gear 66 and act as reduction gears. From the intermediate reduction gears on the right and left, rotation is conveyed with reduced speed to the gears of the drive shafts 61*a* to 61*e* that are disposed between the intermediate reduction gears. A lower gear of the intermediate reduction gear and the gear of the drive shaft are also helical gears. In this manner, the two intermediate reduction gears are used, so that offset load is eliminated and bending does not occur on a screw shaft. Moreover, since helical gears are used, backlash can be eliminated. It is preferable that a backlash correcting collar 68 is provided on the top of the bearing (thrust bearing) of each of the driving shafts 61*a* to 61*e* to receive thrust load from the shaft.

Figure 12:
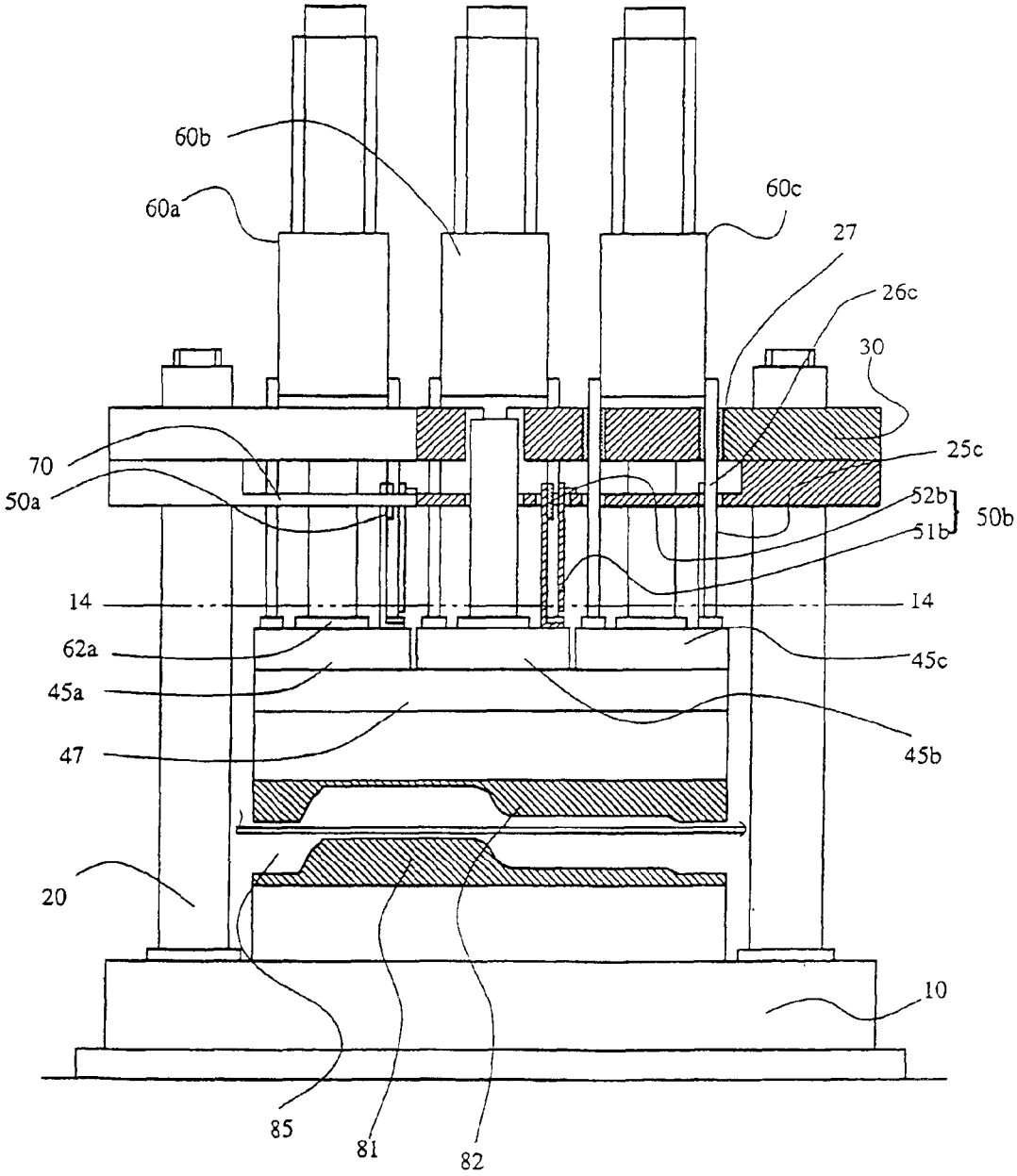
FIG. 12 is a front view showing a press forming machine according to still another example of the present invention.
Figure 13:
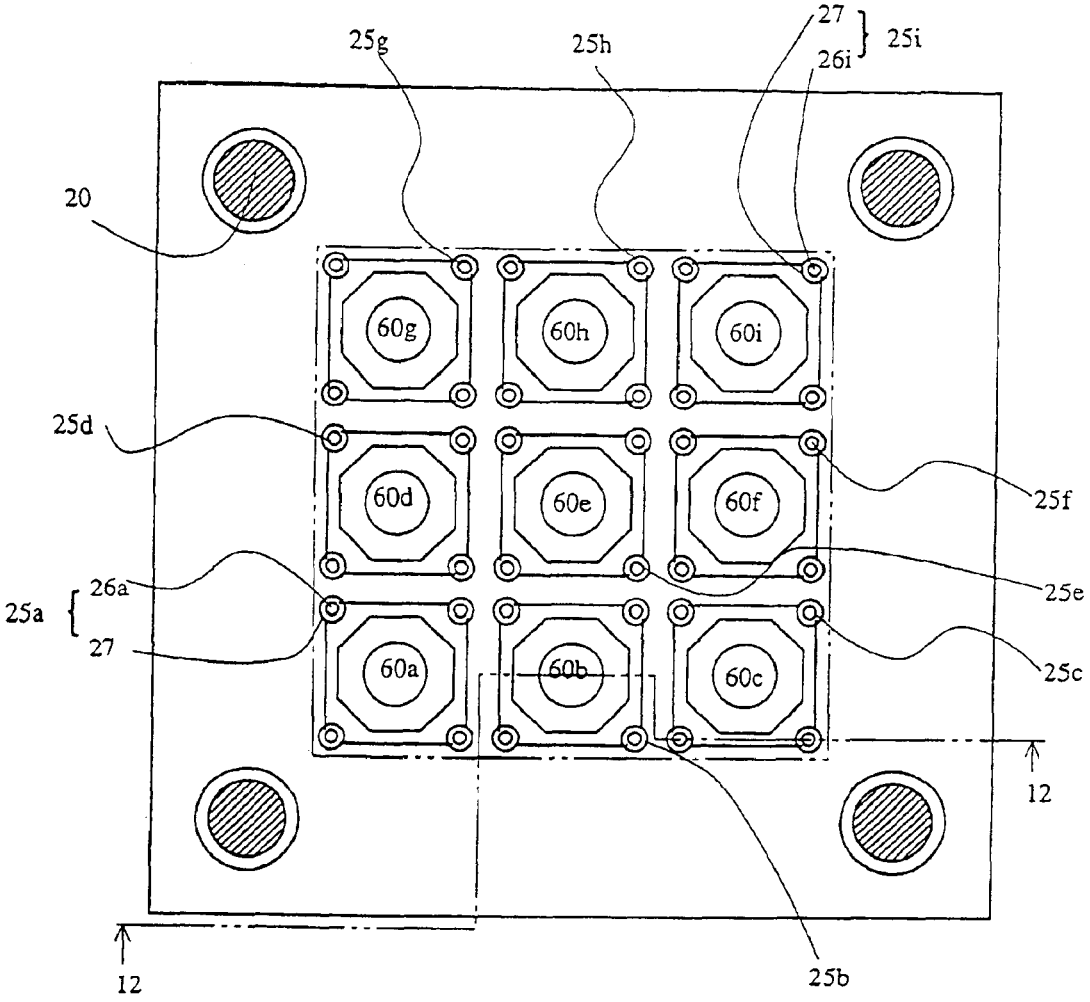
FIG. 13 is a plan view showing the press forming machine of FIG. 12.
Figure 14:
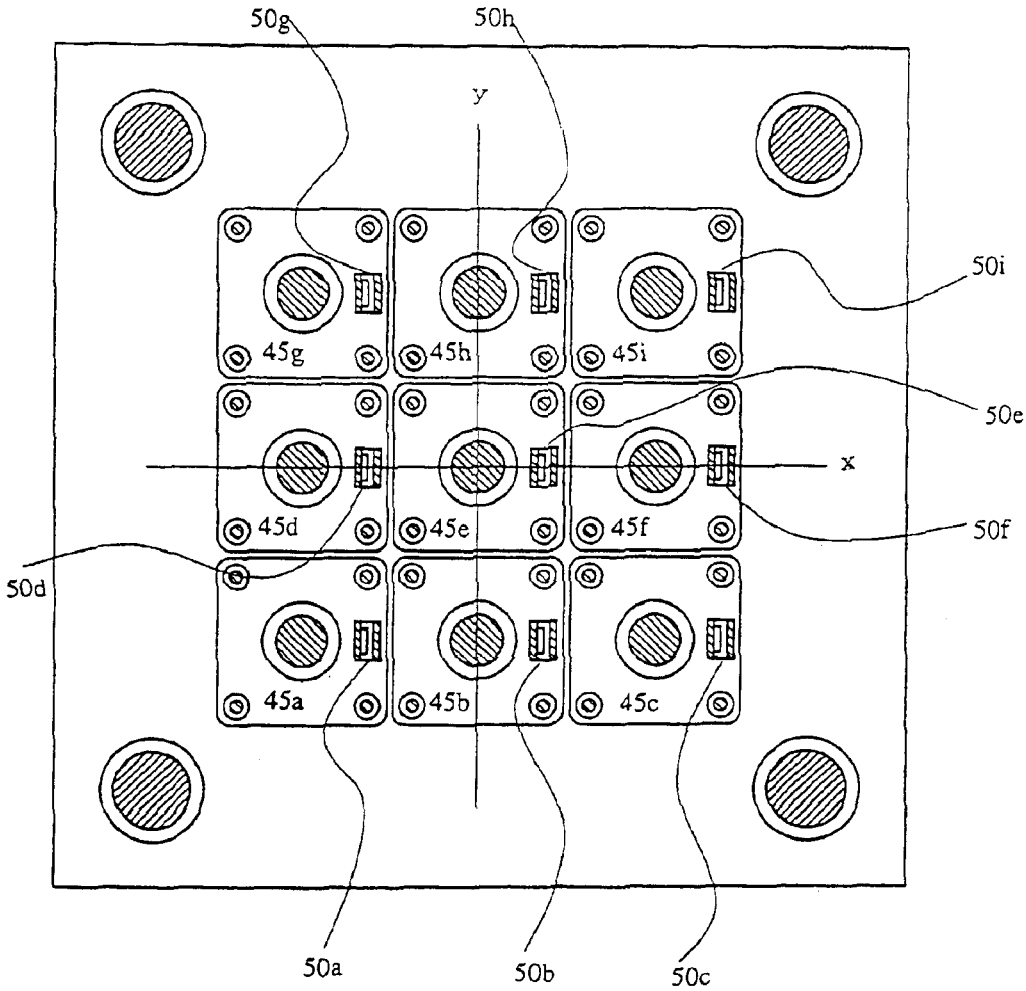
FIG. 14 is a sectional view showing the press forming machine of FIG. 12 taken along line 14—14.

Referring to FIGS. 12 to 14, still another example of the present invention will be described. FIG. 12 is a front view of a press forming machine and is also a sectional view taken along line 12—12 of FIG. 13. FIG. 13 is a plan view of the press forming machine. FIG. 14 is a sectional view taken along ling 14—14 of FIG. 12. In FIGS. 12 to 14, an upper support stand 10, columns 20, an upper support plate 30, a reference plate 70, a fixed mold 81, and a movable mold 82 are identical to those of FIGS. 1 and 2. A plurality of pressurizing plate units 45*a* to 45*i* is provided which travels between the lower support stand 10 and the upper support plate 30. A molding space 85 is provided between the pressurizing plate units and the lower support stand. A movable mold (cope) 82 corresponding to a fixed mold is placed below the pressurizing plate units.

A plurality of pressure units (here, nine units are provided) is attached to the upper support plate. The pressure units have driving sources 60*a* to 60*i*, each being composed of a servomotor and the like, on the tops, and the drive shafts of the driving sources vertically moves the pressurizing plate units 45*a* to 45*i*. An engaging part 62*a* is formed with, for example, a ball joint. The pressurizing plate units 45*a* to 45*i* includes displacement measuring means 50*a* to 50*i* for measuring displacements and guide mechanism 25*a* to 25*i* for preventing the pressurizing plate units 45*a* to 45*i* from being inclined. In FIGS. 12 to 14, guide pins 26*a* to 26*i* are provided respectively on the four corners of the pressurizing plate units 45*a* to 45*i*. Each of the pressurizing plate units has four guide pins. Guides 27 for preventing the inclination of the guide pins are provided in the openings of the upper support plate 30. When the pressurizing plate units move vertically, the guide pins slide along the guides so as to support the pressurizing plate units without inclination. The guide mechanisms 25*a* to 25*i* are each constituted by the guide pins 26*a* to 26*i* and the guides 27. The displacement measuring means 50*a* to 50*i* are identical to those of the press forming machine shown in FIG. 1.

In FIG. 12, magnetic scales 51*a* to 51*i* of the displacement measuring means are attached to a reference plate 70 which is provided over the columns 20 of the press forming machine. In the present example as well, the magnetic scales are attached to the reference plate 70, which is not deformed during molding. Thus, even when a large load is applied, a displacement can be measured.

The pressurizing plate is constituted by the pressurizing plate units 45*a* to 45*i* which are respectively disposed under the nine pressure units. Each of the pressurizing plate units can vertically move separately from the other pressurizing plate units. A connection plate 47 is provided under the pressurizing plate units. The pressurizing plate units are attached on the upper surface of the connecting plate 47, and the individual movements of the pressurizing plate units act as a vertical movement of the entire configuration. Die sets are positioned between the connecting plate and the lower support stand, and a mold is secured between the die sets.

Figure 18A:
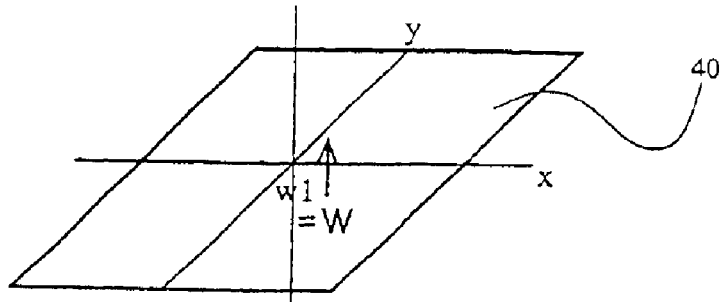
FIGS. 18A, 18B, and 18C are diagrams schematically showing reaction force applied to the slide plate of a press forming machine with the passage of time.

Here, the operation of the pressurizing plate units will be discussed. As shown in FIG. 14, it is assumed that totally nine pressurizing plate units 45*a* to 45*i* are arranged three by three longitudinally and laterally on a plane. When molding is started assuming that x axis and y axis are provided at the center, uneven reaction force discussed in FIG. 18 is applied to the pressurizing plate units via the connecting plate 47. At the start of molding, as shown in FIG. 18A, force of a fourth quadrant is applied upward. Thus, the pressurizing plate unit 45*c* mainly receives the force. Since the other pressurizing plate units 45*a*, 45*b*, and 45*d* to 45*i* do not receive such a large force, the units are moved prior to the pressurizing plate unit 45*c*. Such uneven movements of the pressurizing plate units are detected by the displacement measuring means and the driving sources. As will be discussed later, the driving signals to the driving sources are adjusted such that all the pressurizing plate units are equal in displacement.

Figure 18B:
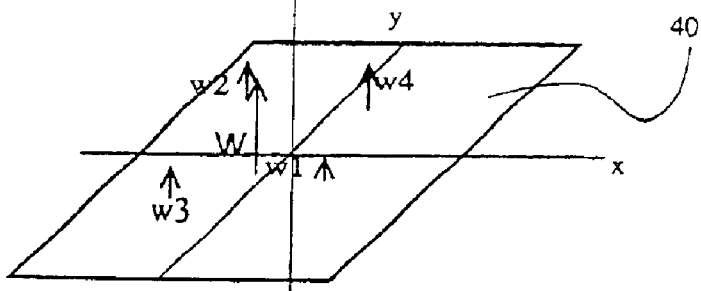

When molding proceeds and reaction force of FIG. 18B is applied, the pressurizing plate units 45*a* and 45*g* are also delayed. Thus, driving signals are adjusted such that all the pressurizing plate units are equal in displacement.

Figure 18C:
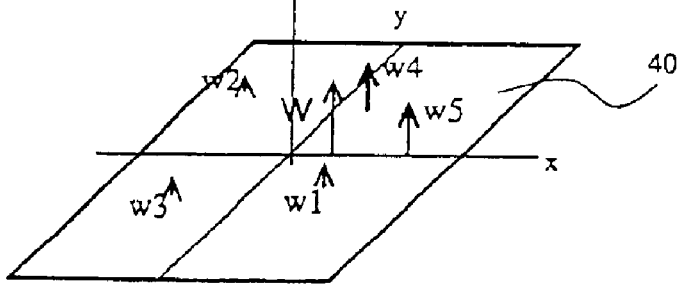

When molding further proceeds and reaction force of FIG. 18C is applied, the pressurizing plate units 45*f* and 45*h* are also delayed. Thus, the number of pulses of driving signals supplied to the driving sources is adjusted such that all the pressurizing plate units are equal in displacement.

In the above example as well, the control means of FIG. 8 is provided in the press forming machine. In the above example, since nine driving sources 60*a* to 60*i* and nine displacement measuring means 50*a* to 50*i* are provided, it is assumed that FIG. 8 is similarly configured. Upon molding, control means 92 drives the driving sources 60*a* to 60*i* via the interface 94 to carry out molding. As the molding proceeds, displacement measured values of the pressurizing plate units are transmitted to the control means 92 from the displacement measuring means 50*a* to 50*i*. During molding, as described before, force applied on a pressurized surface is changed, so that the driving sources 60*a* to 60*i* receive varied resistances according to the change. Some of the driving sources move faster, and others are delayed. The advance and delay are measured by the displacement measuring means 50*a* to 50*i*, the results are transmitted to the control means 92, and the number of driving signal pulses supplied to each of the driving sources 60*a* to 60*i* is changed such that the displacement measuring means 50*a* to 50*i* are equal in displacement.

Even when the pressurizing plate is not supported by the columns of the press forming machine, molding can be performed while a pressurized surface stays in a horizontal position. Hence, even molding is possible without large rotation moment. Although uneven pressure distribution may appear in a small region of the pressurizing plate units, rotation moment caused by uneven pressure distribution is reduced when the pressurizing plate unit has a smaller area. Thus, it is possible to stand sufficiently to rotation moment by using a guide mechanism, which is provided on each of the pressurizing plate units and is composed of guide pins and guides.

When a small work piece is molded using the press forming machine of the above example, for example, it is possible to operate only the pressurizing unit at the center while suspending the surrounding pressurizing units. Further, pre-molding can be performed by three pressurizing units on the left, second molding can be performed by three pressurizing units at the center, and finish molding can be performed by three pressurizing units on the right.

Figure 15:
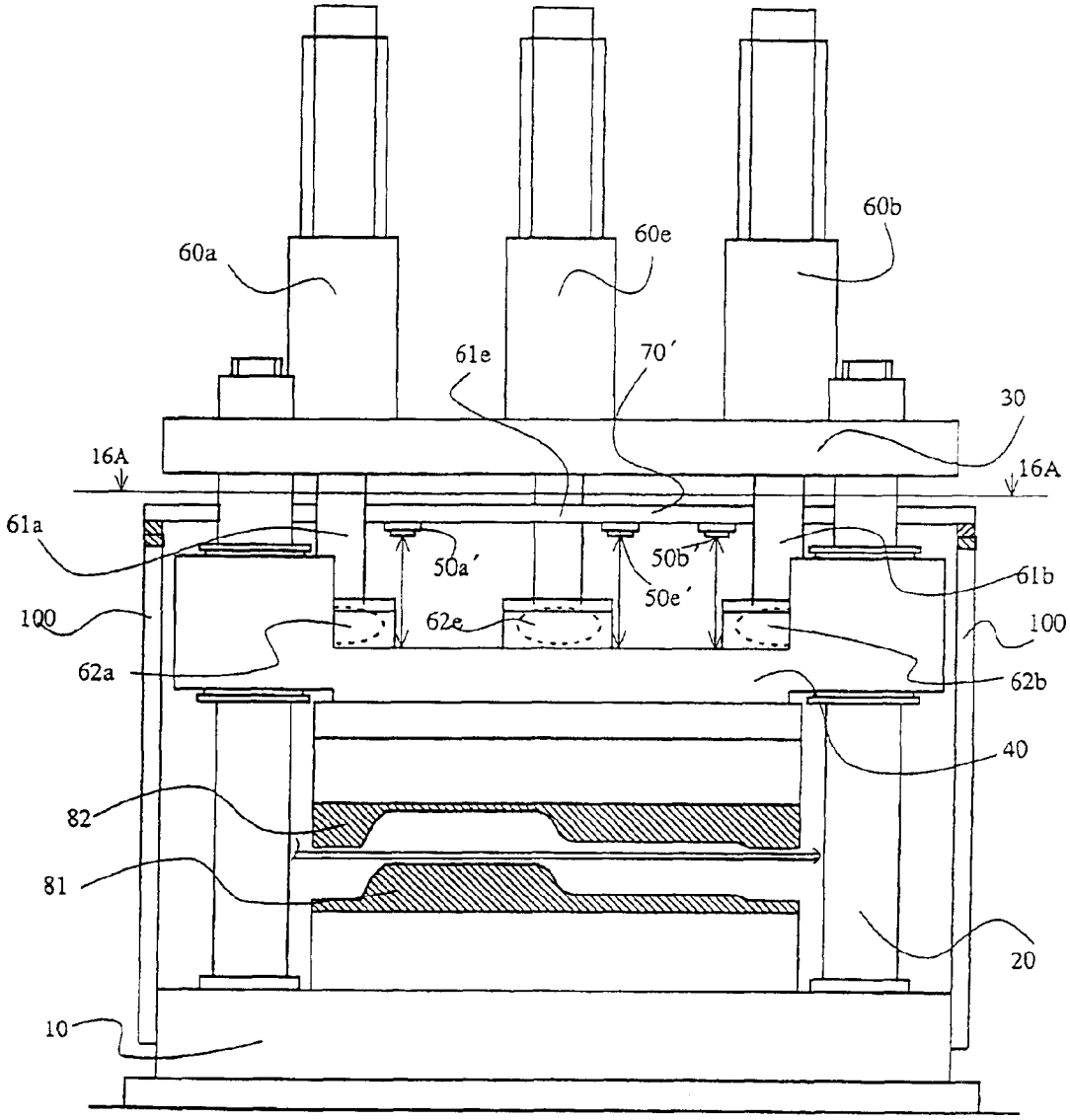
FIG. 15 is a front view showing a press forming machine of another example.
Figure 16A:
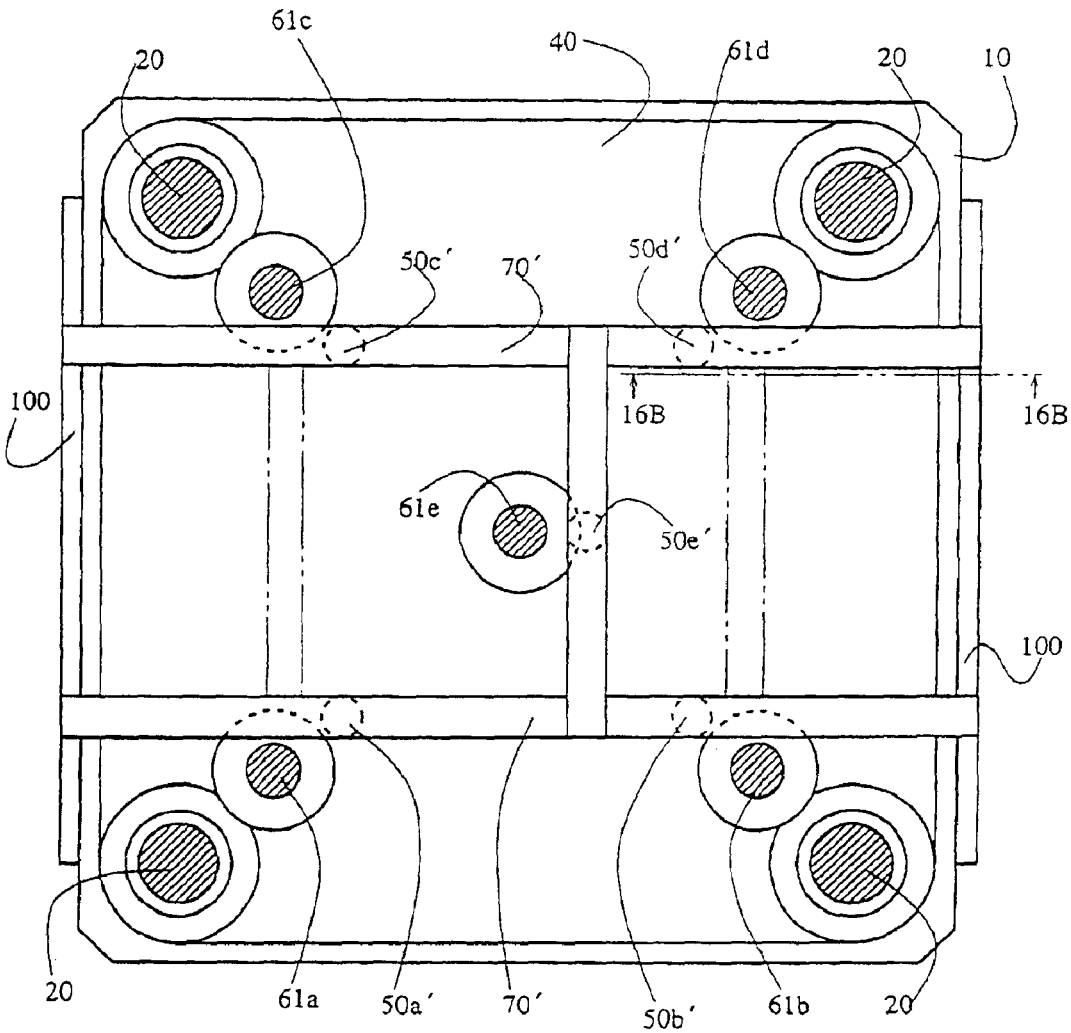
FIG. 16A is a plan view showing the press forming machine of FIG. 15 taken along line 16A—16A.
Figure 16B:
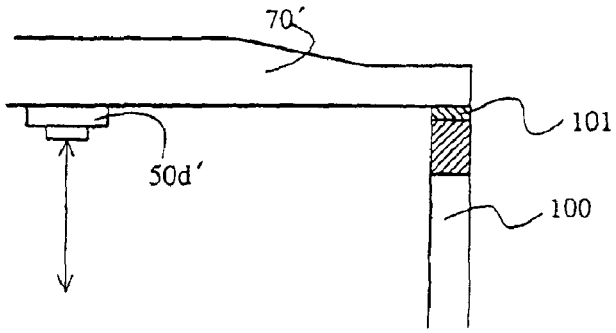
FIG. 16B is a side view showing a reference plate of FIG. 16A taken along line 16B–16B.

FIGS. 15 and 16 show a variation of the press forming machine shown in FIGS. 1 and 2. FIG. 15 is a front view of the press forming machine. FIG. 16A is a plan view of the press forming machine taken along line 16A—16A of FIG. 15. FIG. 16B is a side view of a reference plate taken along line 16B—16B of FIG. 16A.

In the press forming machine of FIGS. 1 and 2, the reference plate 70 is provided under the upper support plate 30 via a gap and is fixed over the columns 20, and the through-holes 71*a*, 71*b*, . . . , 71*e* with sufficient diameters are provided on parts having the drive shafts 61*a*, 61*b*, . . . , 61*e*. Thus, the reference plate is not affected by deformation on the drive shafts and the slide plate. However, it is more preferable that even slight deformation on the upper support plate 30 does not affect the reference plate 70 at all.

In order to solve the above problem, in FIGS. 15 and 16, a reference plate 70' is held and fixed by the lower support stand 10. Besides, in FIG. 15, the detail including displacement measuring means 50*a*', 50*e*', 50*b*' and 50*j*' is omitted. For example, as shown in FIG. 16B, measuring means using light beam is adopted.

As shown in FIG. 16, the reference plate 70' is formed into a shape not interfering with drive shafts 61*a*, 61*b*, 61*c*, 61*d* and 61*e* and columns 20. For example, the reference plate 70' is formed as an H-shaped frame made of titanium. Further, the above-mentioned displacement measuring means 50*a*', 50*b*', 50*c*', 50*d*' and 50*e*' are attached to the frame. Moreover, as shown in FIGS. 15 and 16, the reference plate 70' is supported and fixed by detection columns 100 on the lower support stand 10. As shown in FIG. 16B, it is preferable to dispose a vibration-isolating plate 101 between the reference plate 70' and the detection column 100. Additionally, it is preferable to use a material such as invar, which is less susceptible to heat, for the detection columns 100. With the above configuration, the reference plate 70' is supported and fixed on the lower support stand 10 and is completely independent from deformation on the upper support plate 30.

As discussed before in FIG. 3, teaching is performed in the present invention such that driving positions set by driving of the driving source 60*b* are accurately set at positions A, B, C and F respectively at discrete points of tA, tB, tC and tF. During actual molding, the driving source 60*b* is driven according to data obtained by the teaching.

At this moment, regarding all the driving sources 60*a*, 60*b*, 60*c*, 60*d* and 60*e*, teaching is performed so as to obtain correct positions A, B, C and F respectively on the points tA, tB, tC and tF, and actual molding is performed according to the result.

Although the above-mentioned control is basically adequate, in the case of more precise control, a problem shown in FIG. 17 actually may occur.

Figures 17A, 17B, 17C, 17D:
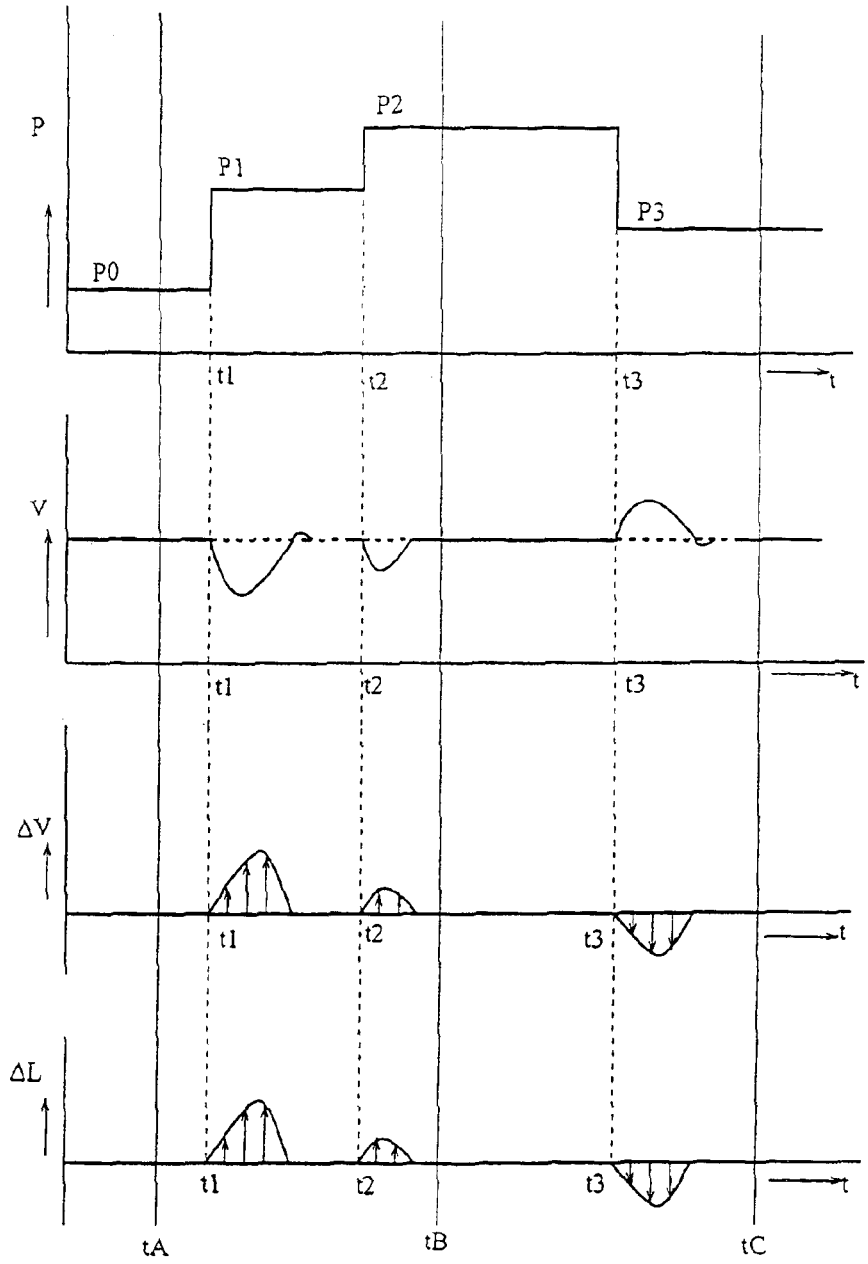
FIGS. 17A, 17B, 17C, and 17D are graphs in which a load applied to a driving source is changed while molding is performed by the driving source and a lateral axis indicates time.

FIG. 17 shows a state in which a load applied to the driving source is changed during molding performed by the driving source. A lateral axis indicates time. FIG. 17A shows a change in load P. FIG. 17B shows a change in descending speed caused by delay in control exercised on the driving source. FIG. 17C shows a speed correcting required amount for correcting a change in speed of FIG. 17B. FIG. 17D shows a position correcting required amount for correcting a positional change resulted from a change in speed of FIG. 17B. Actually, it is sufficient to correct one of the speed correcting required amount of FIG. 17C and the position correcting required amount of FIG. 17D.

In other words, it is preferable that a driving amount of the driving source 60*b* is larger than an original amount for a predetermined period before and after timing t1 of FIG. 1, which was discussed in FIG. 3, a driving amount of the driving source 60*b* is similarly larger for a predetermined period before and after timing t2, and a driving amount of the driving source 60*b* is smaller for a predetermined period before and after timing t3.

Additionally, in general, timing t1, t2, and so on do not conform to timing tA, tB, tC and tF of FIG. 3. Thus, the above-mentioned undesirable change in speed and position cannot be eliminated merely by selecting small intervals between timing tA and tB, between timing tB and tC, and between timing tC and tF to perform precise control.

In view of the above points, during the above trial operation, timing t1, t2, t3, are detected on which load P changes as shown in FIG. 17A, and for a predetermined period from the moment slightly before timing t1 or from timing t1, a driving amount larger than the original amount discussed in FIG. 3 (e.g., the number of driving pulses is increased) or a driving amount smaller than the original amount (e.g., the number of driving pulses is reduced) is applied to, for example, the driving source 60*b*. Additionally, as a method for increasing or reducing a driving amount, a pulse interval of a driving pulse may be changed, or the number of pulses supplied by means (not shown) may be increased or reduced.

In this manner, it is possible to eliminate an error resulted from control delay which was discussed in FIG. 17.

As specifically discussed above, according to the press forming machine of the present invention, the movable mold can be always maintained at a desired position relative to the fixed mold during press forming, and rotation moment can be prevented during molding. Furthermore, molding time can be shortened in the case of repeated molding.

What is claimed is:

1. A press forming machine comprising:

a lower support stand;

an upper support plate held by a plurality of columns supported by the lower support stand;

a slide plate which can reciprocate between the lower support stand and the upper support plate and has a molding space between the slide plate and the lower support stand;

a plurality of servo motors;

the servo motors having drive shafts engaged to an upper surface of the slide plate to make a displacement on the slide plate; and control means for controlling driving of each of the servo motors;

the control means comprising:

a memory which stores control data for each of the servo motors and for each of a plurality of operating steps during that a molding operation in which a load from a workpiece acts on the slide plate is divided into, the control data providing a displacement of each of the servo motors;

the control data for each of the servo motors and for each of the plurality of operating steps including a correction amount corresponding to a change in load on the servo motor during each of the operating steps, and a driving means which, when a molding operation is performed where the load from a workpiece acts on the slide plate, supplies to each of the servo motors the control data stored in the memory for the servo motor and for each of a plurality of operating steps that the performed molding operation is divided into and separately drives the servo motors during each of the plurality of operating steps of the performed molding operation.

2. A press forming machine as set forth in claim 1, wherein the plurality of servo motors are arranged on the slide plate such that driving force by the plurality of servo motors is evenly distributed on the slide plate.

3. A press forming machine as set forth in claim 2, wherein each of the servo motors causes equal driving force relative to each other per control data.

4. A press forming machine as met forth in claim 1, further comprising engaging parts each of which is engaged to the upper surface of the slide plate and is provided on part of the slide plate so as to correspond to each of the servo motors, each of the engaging parts being able to make a displacement on the slide plate by a driving force of the drive shaft of the servo motor, and displacement measuring means which is disposed near each of the engaging parts to measure a displacement of the part of the slide plate;

wherein the control means comprises a control data extracting means, the a control data extracting means measuring a displacement of the slide plate for each of the servo motors by the displacement measuring means during each of the plurality of operating steps of the molding operation, extracting the control data based on the measured displacement for each of the servo motors and for each of the plurality of operating steps to maintain the entire slide plate at a desired displacement position dining the operating steps, and storing the control data in the memory.

5. A press forming machine as set forth in claim 4, wherein the plurality of servo motors are arranged on the slide plate such that driving force by the plurality of servo motors is evenly distributed on the slide plate.

6. A press forming machine as set forth in claim 5, wherein each of the servo motors causes equal driving force relative to each other per control data.

7. A press forming machine as set forth in claim 4, wherein the control data extracting means extracts the control data based on the measured displacement for each of the servo motors and for each of the plurality of operating steps to maintain the entire slide plate in a horizontal position during the operating steps, and stores the control data in the memory.

8. A press forming machine as set forth in claim 4, wherein the slide plate is divided into a plurality of pressurizing plate units, each of which is provided with driving force by each drive shaft of each of the servo motors through the engaging parts on the pressurizing plate units.

9. A press forming machine as set forth in claim 8, wherein the plurality of servo motors are arranged on the slide plate such that driving force by the plurality of servo motors is evenly distributed on the slide plate.

10. A press forming machine as set forth in claim 9, wherein each of the servo motors causes equal driving force relative to each other per control data.

11. A press forming machine as set forth in claim 4, wherein, during a trial molding operation in which the load from a workpiece acts on the slide plate, the control data extracting means measures a displacement of the slide plate for each of the servo motors by the displacement measuring means during each of a plurality of operating steps that the trial molding operation is divided into, extracts a control data based on the measured displacement for each of the servo motors and for each of the plurality of operating steps of the trial molding operation to maintain the entire slide plate at a desired displacement position during each of the operating steps of the trial molding operation and stores the control data in the memory; and when an actual molding operation is performed in which the load from a workpiece acts on the slide plate, the driving means supplies to each of the servo motors the control data stored in the memory for the servo motor and for each of a plurality of operating steps that the actual molding operation is divided into and separately drives the servo motors during each of the plurality of operating steps of the actual molding operation.

12. A press forming machine as set forth in claim 11, wherein the plurality of servo motors are arranged on the slide plate such that driving force by the plurality of servo motors is evenly distributed on the slide plate.

13. A press forming machine as set forth in claim 12, wherein each of the servo motors causes equal driving force relative to each other per control data.

14. A press forming machines as set forth in claim 11, wherein the control data extracting means extracts the control data based on the measured displacement for each of the servo motors and for each of the plurality of operating steps of the trial molding operation to maintain the entire slide plate in a horizontal position during the operating steps of the trial molding operation, and stores the control data in the memory.

15. A press forming machine as set forth in claim 11, wherein the slide plate is divided into a plurality of pressurizing plate units, each of which is provided with driving force by each drive shaft of each the servo motors through the engaging parts on. the pressurizing plate units.

16. A press forming machine as set forth in claim 11, wherein the control data is a driving pulse signal for the servo motor.

17. A press forming machine as set forth in claim 4, wherein the displacement measuring means measures a displacement between the slide plate and a reference plate that is supported and fixed on the lower support stand.

18. A press forming machine as set forth in claim 4, wherein the control data is a driving pulse signal for the servo motor.

19. A press forming machine as set forth in claim 1, wherein the control data is a driving pulse signal for the servo motor.

20. A press forming machine comprising:

a base;

a plurality of columns extending from said base;

a support plate connected to said plurality of columns and arranged spaced from said base;

a slide plate slidably mounted on said plurality of columns;

a plurality of driving sources connected to said slide plate and moving said slide plate on said plurality of columns;

a control unit operating said plurality of driving sources to move said slide plate, and dividing the moving of said slide plate into a plurality of trial steps while a pilot piece is applying an uneven force to said slide plate, said control unit including a memory storing control data providing displacement instructions for each of said plurality of driving sources and for each of said plurality of trial steps, said control unit operating said plurality of driving sources in a plurality of workpiece steps corresponding to said trial steps based on said displacement instructions during actual molding of a workpiece.

21. A press forming machine in accordance with claim 20, wherein:

the workpiece is placed in-between said slide plate and said base, the workpiece applying an uneven force and time varying force to said slide plate as said slide plate moves toward said base;

said displacement instructions compensate for said time varying force and maintain said slide plate at a predetermined attitude with respect to said base during each of said workpiece steps when said slide plate moves toward said base.

22. A press forming machine in accordance with claim 21, wherein:

said displacement instructions are predetermined from movements of said slide plate pressing previous workpieces.

23. A press forming machine comprising:

a lower support stand;

an upper support plate held by a plurality of columns supported by the lower support stand;

a slide plate which can reciprocate between the lower support stand and the upper support plate and has a molding space between the slide plate and the lower support stand;

a plurality of servo motors;

the servo motors having drive shafts engaged to an upper surface of the slide plate to make a displacement on the slide plate;

control means for controlling driving of each of the servo motors; and displacement measuring means which is disposed near each of parts of the slide plate engaging each of the drive shaft;

the control means comprising: a control data extracting means, a memory and a driving means, wherein, during a molding operation in which a load from a workpiece acts on the slide plate, the control data extracting means measures a displacement of the slide plate for each of the servo motors by the displacement measuring means during each of a plurality of operating steps that the molding operation is divided into, extracts a control data based on the measured displacement for each of the servo motors and for each of the plurality of operating steps of the molding operation to maintain the entire slide plate at a desired displacement position during the operating step, and stores the control data in the memory;

wherein the memory stores the control data for each of the servo motors and for each of the plurality of operating steps, the control data providing a displacement of each of the servo motors; and wherein, when a molding operation is performed in which the load from a workpiece acts on the slide plate, the driving means supplies to each of the servo motors the control data stored in the memory for each of the servo motors and for each of a plurality of operating steps that the performed molding operation is divided into and separately drives the servo motors during each of the plurality of operating steps of the performed molding operation.

24. A press forming machine as set forth in claim 23, wherein the control data extracting means extracts the control data based on the measured displacement for each of the servo motors and for each of the plurality of operating steps to maintain the entire slide plate in a horizontal position during the operating step, and stores the control data in the memory.

25. A press forming machine as set forth in claim 23, wherein, during a trial molding operation in which the load from a workpiece acts on the slide plate, the control data extracting means measures a displacement of the slide plate for each of the servo motors by the displacement measuring means during each of a plurality of operating steps that the trial molding operation is divided into, extracts a control data based on the measured displacement for each of the servo motors and for each of the plurality of operating steps of the trial molding operation to maintain the entire slide plate at a desired displacement position during the operating step of the trial molding operation and stores the control data in the memory; and when an actual molding operation is performed in which the load from a workpiece acts on the slide plate, the driving means supplies to each of the servo motors the control data stored in the memory for the servo motor and for each of a plurality of operating steps that the actual molding operation is divided into and separately drives the servo motors during each of the plurality of operating steps of the actual molding operation.

26. A press forming machine as set forth in claim 25, wherein the control data extracting means extracts the control data based on the measured displacement for each of the servo motors and for each of the plurality of operating steps of the trial molding operation to maintain the entire slide date in a horizontal position during the operating step of the trial molding operation, and stores the control data in the memory.

27. A method for operating a press, the method comprising the steps of:

providing a base;

providing a plurality of columns extending from said base;

providing a support plate connected to said plurality of columns and arranged spaced from said base;

providing a slide plate slidably mounted on said plurality of columns;

providing a plurality of driving sources connected to said slide plate and moving said slide plate on said plurality of columns;

placing a pilot piece between said base and said slide plate;

processing the workpiece by moving said slide plate toward said base, the pilot piece applying an uneven force to said slide plate during said processing;

dividing the moving of said slide plate into a plurality of trial steps while the pilot piece is applying the uneven force to said slide plate;

determining displacement instructions for each of said driving sources to maintain said slide plate at a predetermined attitude at each of said trial steps with respect to said base during said processing of the pilot piece;

placing a workpiece between said base and said slide plate;

operating said plurality of driving sources according to said displacement instructions to move said slide plate toward said base and process the workpiece in a plurality of workpiece storm corresponding to said trial steps.

28. A method in accordance with claim 27, wherein:

said displacement instructions operate said driving sources while the workpiece applies a load to said slide plate.

29. A method in accordance with claim 27, wherein said displacement instructions maintain said slide plate at said predetermined attitude with respect to said base dining actual molding of the pilot piece.

30. A method in accordance with claim 27, further comprising:

storing said displacement instructions in a memory prior to said processing of the workpiece.

31. A method in accordance with claim 27, wherein:

the uneven force applies a time varying load during said processing;

said dividing into a plurality of trial steps is performed to have the time varying load be different between said trial steps.

32. A method in accordance with claim 31, wherein:

said determining of displacement instructions includes determining different instructions between said trial steps of one of said driving sources.

33. A method in accordance with claim 27, wherein:

maid displacement instructions both increase and decrease force during said operating of said driving sources.

* * * * *

UNITED STATES PATENT AND TRADEMARK OFFICE

CERTIFICATE OF CORRECTION

PATENT NO. : 6,810,704 B2
DATED : November 2, 2002
INVENTOR(S) : Futamura et al.

It is certified that error appears in the above-identified patent and that said Letters Patent is hereby corrected as shown below:

Column 16,
Lines 3-4, “operating steps during that” should read -- operating steps that --.
Line 28, “as met forth” should read -- as set forth --.
Line 39, “the a control data” should read -- the control data --.
Line 47, “position dining the operation steps” should read -- position during the operation steps --.

Column 17,
Line 47, “engaging parts on. the” should read -- engaging parts on the --.

Column 20,
Line 6, “processing the workpiece” should read -- processing the pilot piece --.
Line 23, “workpiece storm corresponding” should read -- workpiece steps corresponding --.
Line 33, “dining actual molding of the pilot piece” should read -- during actual molding of the workpiece --.

Signed and Sealed this

Eighth Day of November, 2005

JON W. DUDAS
*Director of the United States Patent and Trademark Office*